US006104147A

United States Patent [19]

Nakamura et al.

[11] Patent Number: 6,104,147

[45] Date of Patent: Aug. 15, 2000

[54] PULSE GENERATOR AND DISCHARGE LAMP LIGHTING DEVICE USING SAME

[75] Inventors: Toshiaki Nakamura, Kadoma; Takeshi Kamoi, Uji; Tsutomu Shiomi, Kita Katsuragi-gun, all of Japan

[73] Assignee: Matsushita Electric Works, Ltd., Osaka, Japan

[21] Appl. No.: 09/177,979

[22] Filed: Oct. 22, 1998

[30] Foreign Application Priority Data

Oct. 28, 1997 [JP] Japan ..... 9-296051
Oct. 28, 1997 [JP] Japan ..... 9-312832

[51] Int. Cl.[7] ..... H05B 37/00

[52] U.S. Cl. ..... 315/289; 315/239; 315/240; 315/103; 315/DIG. 5

[58] Field of Search ..... 315/206, 208, 315/239, 240, 225, 289, DIG. 5, 99, 103, 106

[56] References Cited

U.S. PATENT DOCUMENTS 3,917,976 11/1975 Nuckolls ..... 315/258
3,978,368 8/1976 Tomura et al. ..... 315/99
4,005,336 1/1977 Casella .
4,238,711 12/1980 Wallot ..... 315/324
4,348,615 9/1982 Garrison et al. ..... 315/219
4,441,053 4/1984 Daspit ..... 315/206

FOREIGN PATENT DOCUMENTS 59-52599 4/1984 Japan .
4-277567 5/1994 Japan .

*Primary Examiner*—Haissa Philogene
*Attorney, Agent, or Firm*—Lynn & Lynn

[57] ABSTRACT

A pulse generator for a stable output pulse voltage obtains a high voltage pulse with a charge accumulated in a capacitor and discharged at a discharge gap made ON, wherein a pulse energy source and a trigger source for conduction of the discharge gap are separately provided, so that the discharge gap will be conducted by a boosting action of the trigger source when a predetermined value is reached by a voltage of the pulse energy source.

24 Claims, 23 Drawing Sheets

E1
VGon

E2
VGon

VG
GAP-ON
GAP-ON
VGon

VG
GAP-ON
GAP-ON

E1

E2
VGon

VG
VGon

VG

PULSE GENERATOR AND DISCHARGE LAMP LIGHTING DEVICE USING SAME

BACKGROUND OF THE INVENTION

This invention relates to a pulse generator for generating a high voltage pulse, and to a device for lighting a high pressure discharge lamp using the particular pulse generator.

DESCRIPTION OF RELATED ART

In order to light such high pressure discharge lamp, i.e., HID lamp, as a high-pressure sodium lamp, metal halide lamp and so on, generally, it has been required to apply to the discharge lamp a high voltage for starting a discharge, and there have been known a variety of circuit arrangements therefor.

U.S. Pat. No. 4,005,336 to Daniel C. Casella discloses a device in which a ballast connected to an AC power source, a transformer connected to an output end of the ballast, a surge voltage protector (SVP) connected to an intermediate tap of the transformer, and a capacitor connected to a terminating end of the transformer are connected, a junction point between the transformer and the capacitor is connected through a resistor to the other output end of the ballast, a discharge lamp is connected between the terminating end of the transformer and the other output end of the ballast, the capacitor is charged with a secondary voltage of the ballast, SVP is made ON as a charging voltage of the capacitor reaches an ON voltage of SVP to cause a charge in the capacitor to be discharged, and a pulse voltage is generated at the transformer for starting the discharge lamp. The arrangement is so made that SVP will be turned ON every half cycle of the AC power of the source, and the capacitor will be so charged as to generate a starting voltage taking into account a rise in the starting voltage due to the life of the discharge lamp.

As another known discharge lamp lighting device, Japanese Utility Model Laid-Open Publication No. 59-52599 discloses an arrangement comprising a ballast connected to an AC power source for supplying a power to the high pressure discharge lamp as a load and maintaining the lighting of the lamp, and a pulse generator as an igniter for generating a high voltage. In this case, the AC power source turned ON causes a secondary voltage of the ballast to be applied across the high pressure discharge lamp. When the AC power source of the pulse generator is made ON next, a DC high voltage circuit operates to charge the capacitor, and a voltage across the capacity rises gradually. As the voltage reaches a discharge starting voltage of discharge gap, a dielectric breakdown takes place at the discharge gap, the charge accumulated in the capacitor is abruptly discharged through a pulse transformer, and the voltage across the capacitor rapidly drops, upon which a high voltage pulse is generated at secondary winding of the pulse transformer, and this high voltage pulse is applied through a bypass capacitor to the both ends of the high voltage discharge lamp for starting thereof. When this first time pulse is not sufficient for the starting, the charge and discharge of the capacitor are repeated to generate the pulse voltage sequentially and, upon starting of the discharge lamp, the operation of the pulse generator is ceased to stop the pulse voltage generation.

Still another known discharge lamp lighting device is disclosed in Japanese Patent Application No. 4-277567, which comprises a pulse generator as the igniter to have first and second charging circuits, a three-terminal discharge gap having a pair of main electrodes and a trigger electrode, and a pulse transformer, and they are so arranged that a charge in the first charging circuit is discharged through the trigger electrode and a charge in the second charging circuit is discharged through the main electrodes as triggered by the discharge of the first charging circuit, so that a second pulse voltage provided by the discharging of the second charging circuit is lower in the peak value than a first pulse voltage provided by the discharging of the first charging circuit but is larger in the pulse width, which two pulse voltages are applied to the discharge lamp as superposed on each other, whereby the arrangement is made to allow the first pulse voltage for starting the discharge lamp to be contributive to a generation of a grow discharge and the second pulse voltage for being contributive to a shift of the grow discharge to an arc discharge to be generated by a single switching element.

Provided here that the high pressure discharge lamp once lighted off after stable lighting and is to be started again through a relatively short lighted-off period, that is, in a so-called hot-restart in a state where light emitting tube of the high pressure discharge lamp is at a high temperature, it is required to apply a pulse voltage much higher than that required for a so-called cold start in a state where the light emitting tube is at a normal temperature. Accordingly, an effective switching means of such pulse generator will be such an element as an air gap which can perform switching operation at higher voltage and can allow a large current to flow, which element has been generally employed. With such three-terminal controlling type semiconductor switching element as TRIAC, thyristor and the like, it is difficult to deal with such high voltage and large current and, even when the use of such element is realized, the element has been large and expensive, so as to be poor in the general use property.

When the hot-restart is not performed and a pluse of a relatively low voltage is sufficient, it is possible to attain a stable pulse generation with such three-terminal control type semiconductor switching element as TRIAC, thyristor or the like employed, but such two-terminal, voltage-responsive type switching element as SSS (silicon symmetrical switch) and the like will be more advantageous from a viewpoint of costs.

In the event where the gap element forming the discharge gap as in the above is employed, however, the gap element has such problem that a voltage for starting the discharge at the gap, that is, an ON voltage of gap is unstable. This is due to such various cause as the temperature of charged gas in the gap element, state of ions, presence or absence of residual electron, temperature of electrodes, difference in the shape of the electrodes, wear of electrodes after long use, chemical change in the gas, manufactural fluctuation in the same specification and so on.

Generally, the ON voltage of gap involves a fluctuation of ± several 10% with respect to a designed value. For example, a gas charged gap element of a type SSG1X-1 by SIEMENS is optimumly designed and manufactured shows a fluctuation in the gap-ON voltage taking into account the long use and so on for about 800 to 1400V, that is, 1100V±27%.

In designing an igniter using the gap element, therefore, it is required to fully consider such fluctuation in the gap-ON voltage. The igniter must be designed to be able to secure the minimum required pulse voltage $V_{p\text{-}min}$ for starting the discharge lamp. That is, the igniter is designed so that a pulse of a value more than $V_{p\text{-}min}$ will be generated at the lower limit value $V_{SW\text{-}min}$ of the gap-ON voltage fluctuation, as a result of which the igniter in the known circuit is to generate a pulse voltage of the maximum value $V_{p\text{-}max}$ at the upper limit value $V_{sw\text{-}max}$ of the gap-ON voltage fluctuation.

Consequently, the design has to be made with such wasteful factors as an elevation of the withstand voltage characteristics of parts, an enlargement in device dimensions due to required expansion of creepage distance, rise in required componential costs and so on. Further, there is a possibility that the lamp electrodes are quickly worn due to the rise in the applied voltage to the lamp upon its starting.

These problems are occurring also in the case of such semiconductor switching elements of two-terminal, voltage-responsive type as SSS and the like, and the problems should be caused by the unstable ON voltage of the gap element, SSS or the like switching element of the two-terminal voltage responsive type.

In the case of the gap element, further, it is possible to optionally control the operation timing by means of a three terminal gap having trigger electrodes, but there arise other problems that the element is low in the general purpose properties and is not satisfactory in the manufacturing costs.

SUMMARY OF THE INVENTION

An object of the present invention is to provide a pulse generator capable of overcoming the foregoing problems and rendering the high voltage pulse to be stable even when the switching element of two-terminal voltage-responsive type comprises the gap element or semiconductor switching element.

It is another object of the present invention to provide a discharge lamp lighting device capable of reliably lighting the discharge lamp with a stable high voltage pulse for the starting made obtainable while enabling the device to be minimized in size and in manufacturing costs and to be improved in safety.

In order to accomplish the above objects, the present invention provides a pulse generator wherein a trigger source means is connected across a two-terminal voltage-responsive switching element made conductive when a both end voltage reaches a predetermined responsive voltage, for conducting the switching element by applying such voltage, characterized in that the device is provided with an energy supply source means for supplying an energy to the switching element and to a load circuit connected in series to the switching element upon conduction of the switching element.

Other objects and advantages of the present invention shall become clear as the description of the invention advances as detailed with reference to preferred embodiments shown in accompanying drawings.

BRIEF DESCRIPTION OF THE INVENTION

Figure 8:
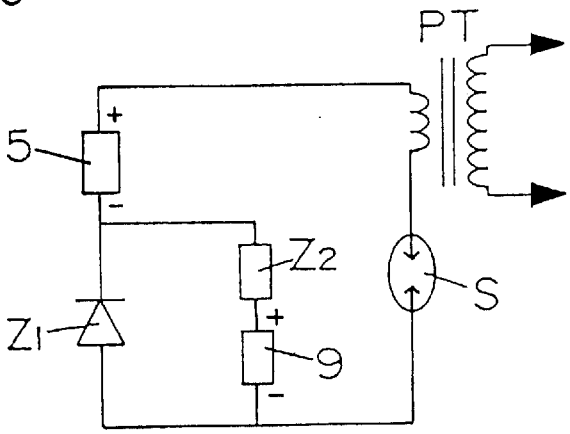
FIG. 8 is a circuit arrangement showing another practical example in the series system of the pulse generator according to the present invention.
Figure 9A:
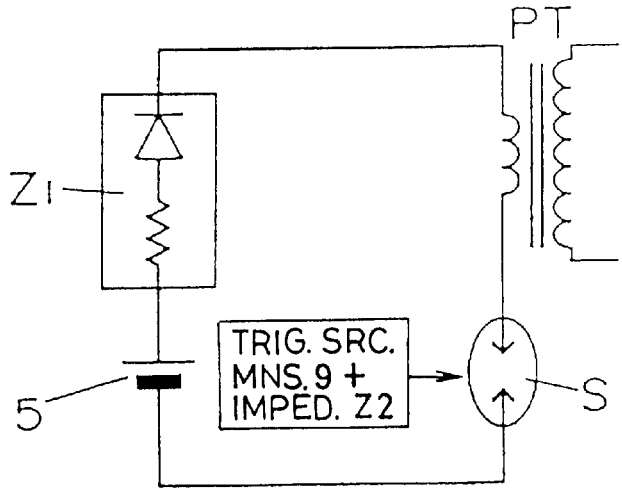
Figure 9B:
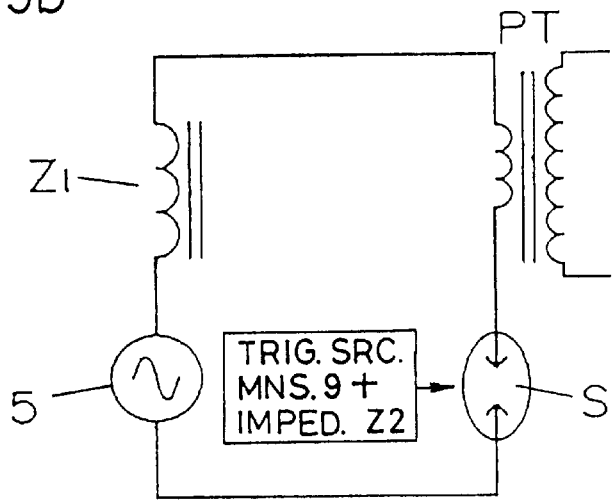
Figure 9C:
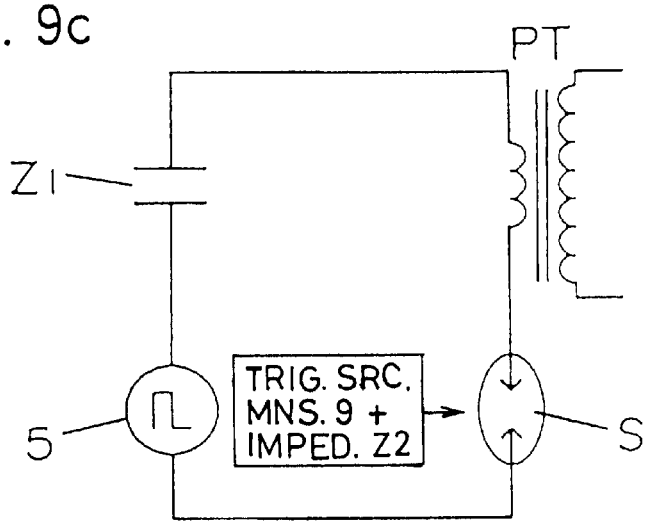
Figure 11:
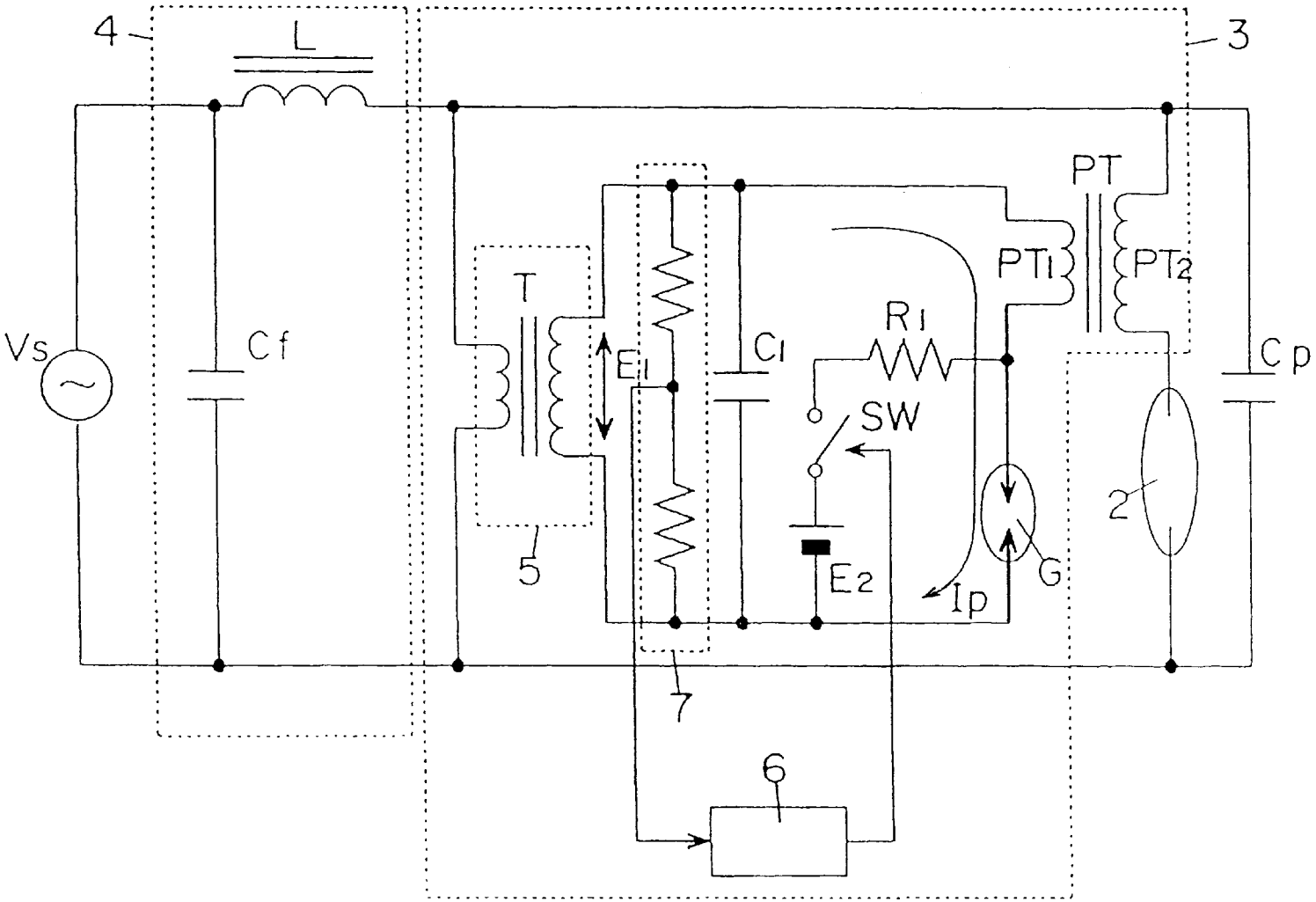
Figure 13:
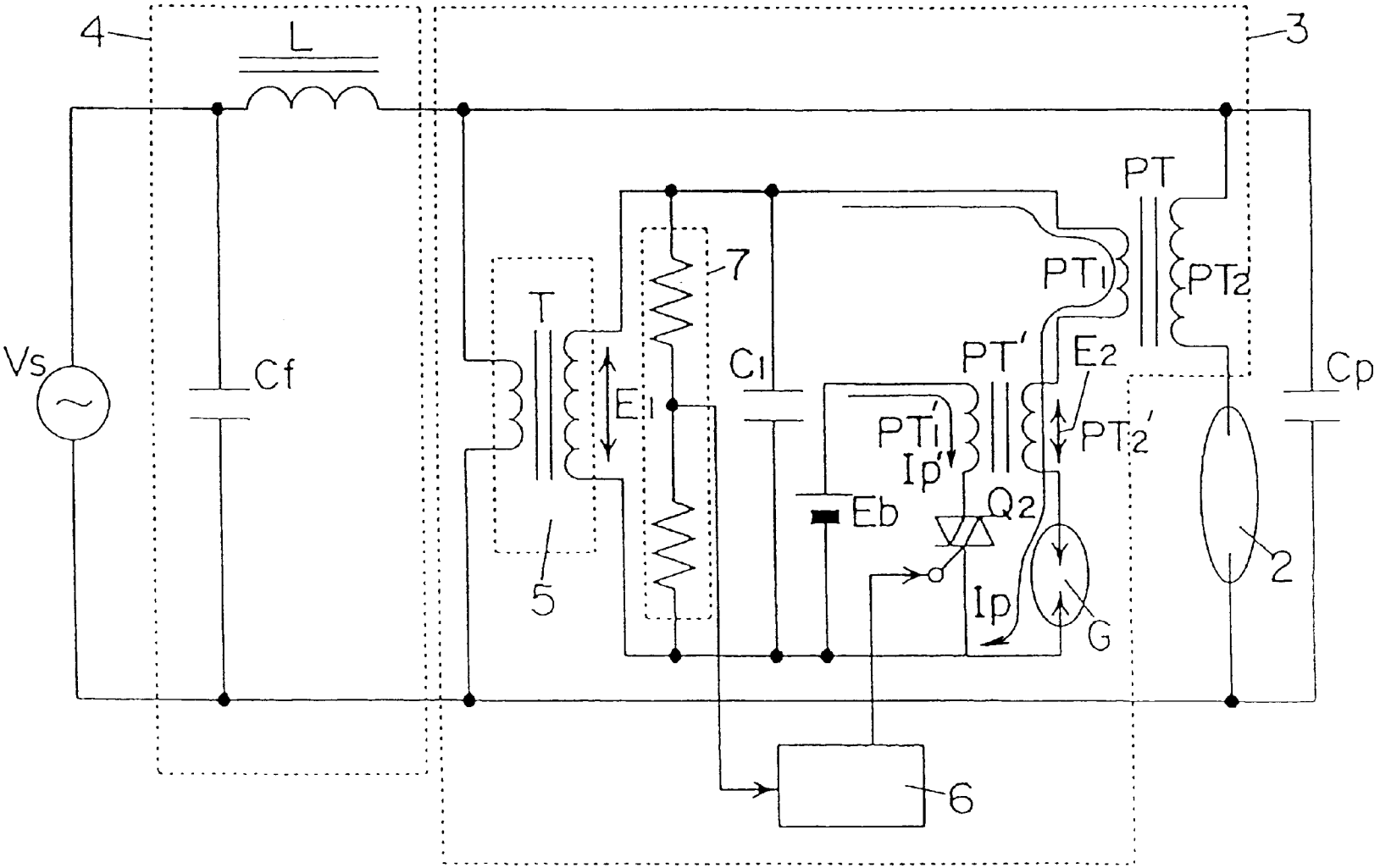
Figure 20:
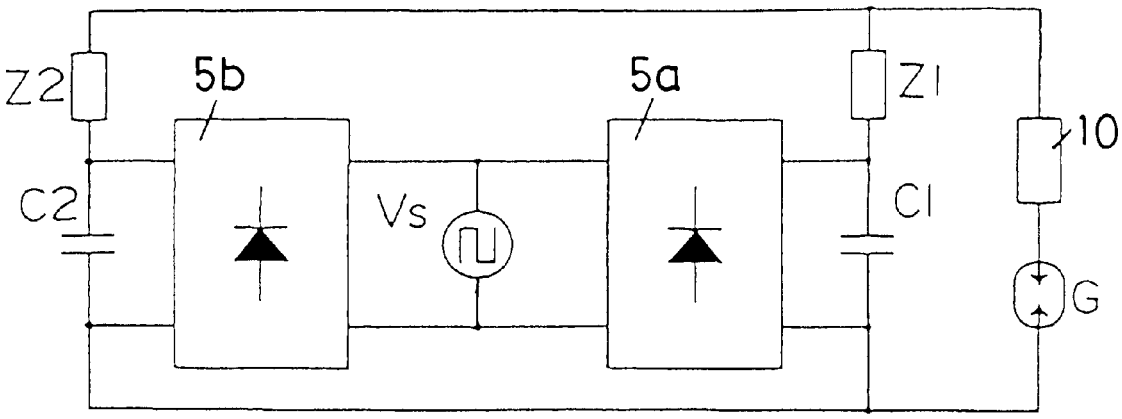
Figure 21:
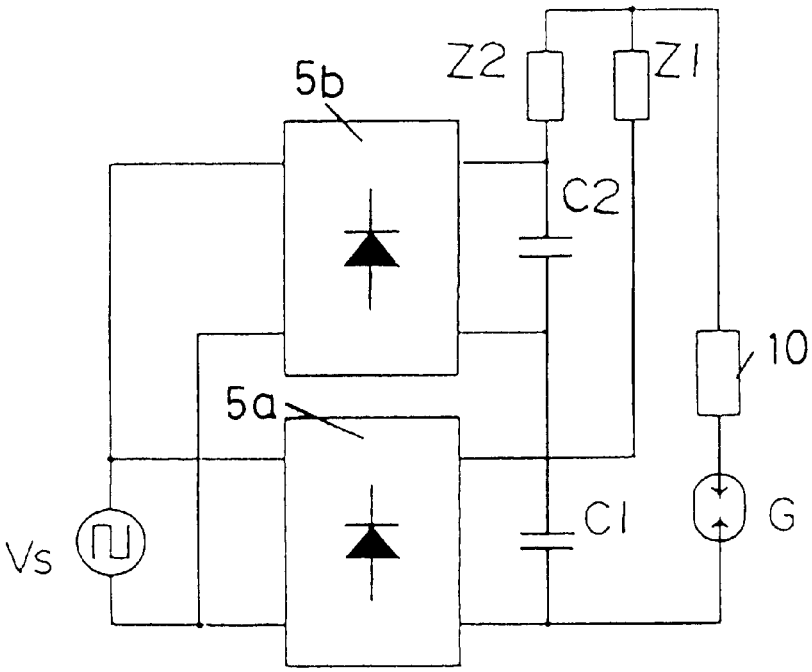
Figure 22:
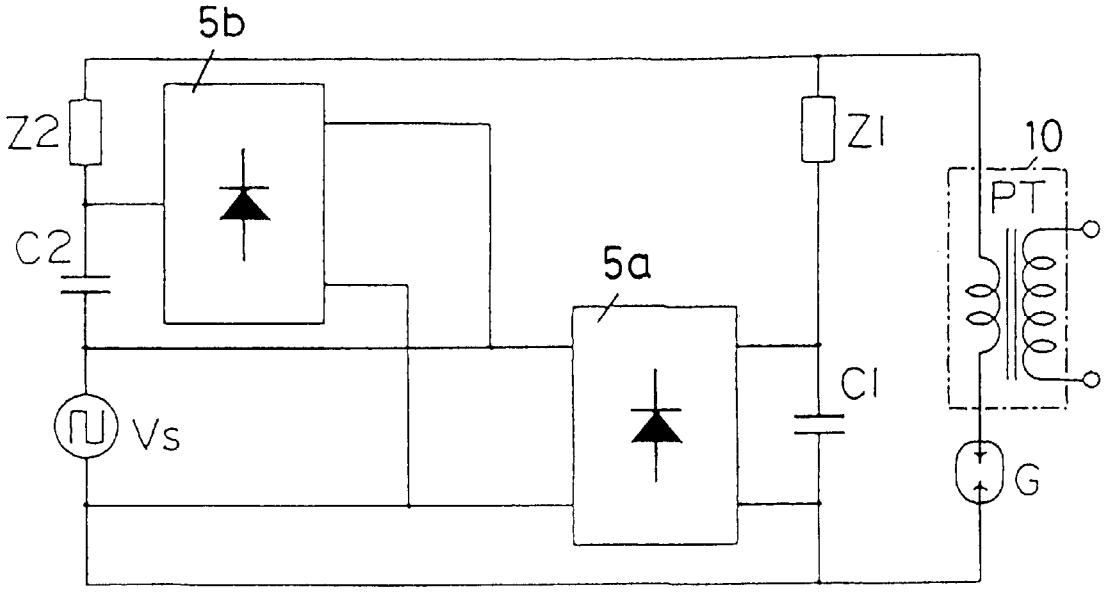
Figure 23:
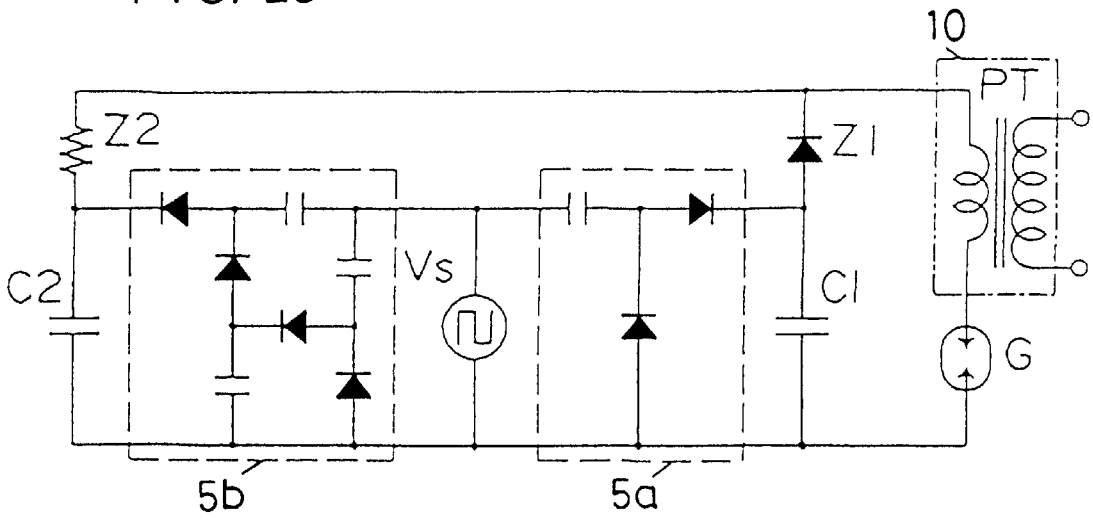
Figure 24A:
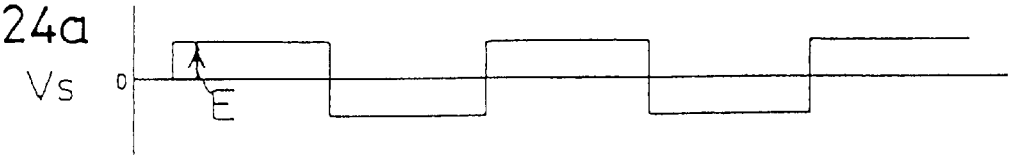
Figure 24B:
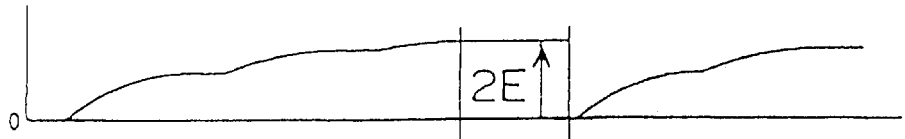
Figure 24C:
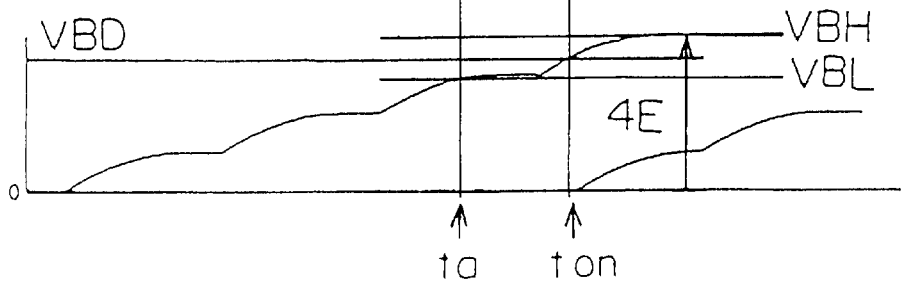
Figure 25:
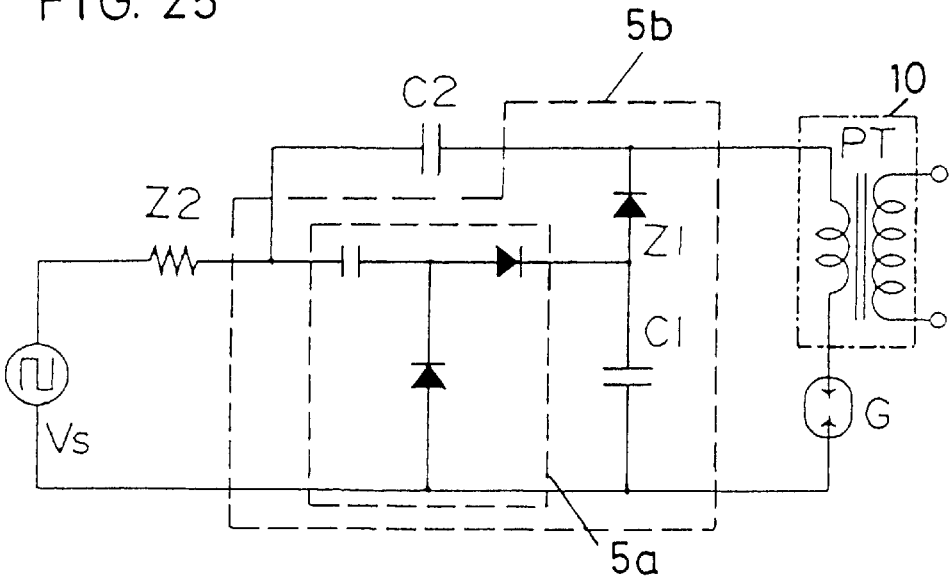
Figure 26:
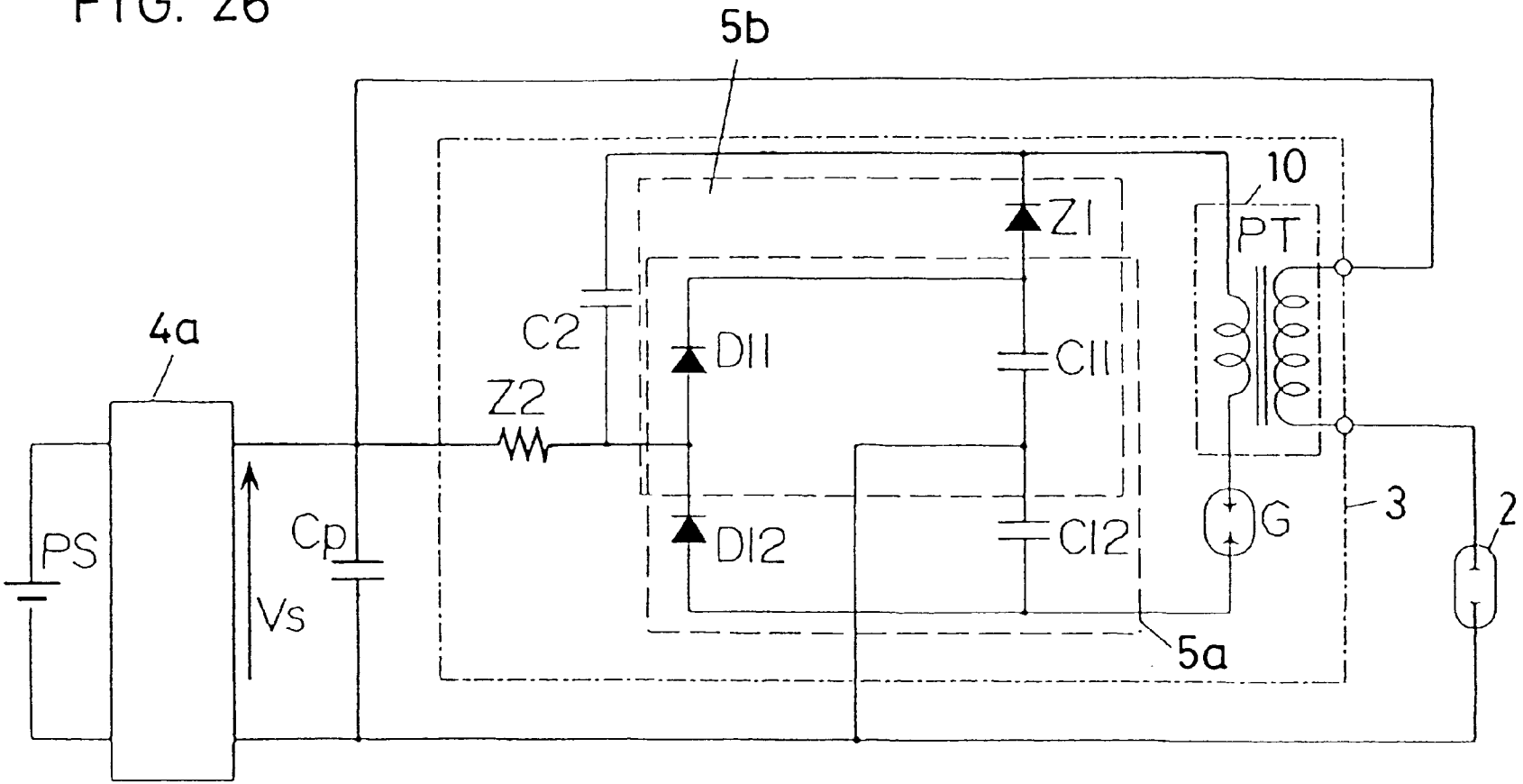
Figure 28:
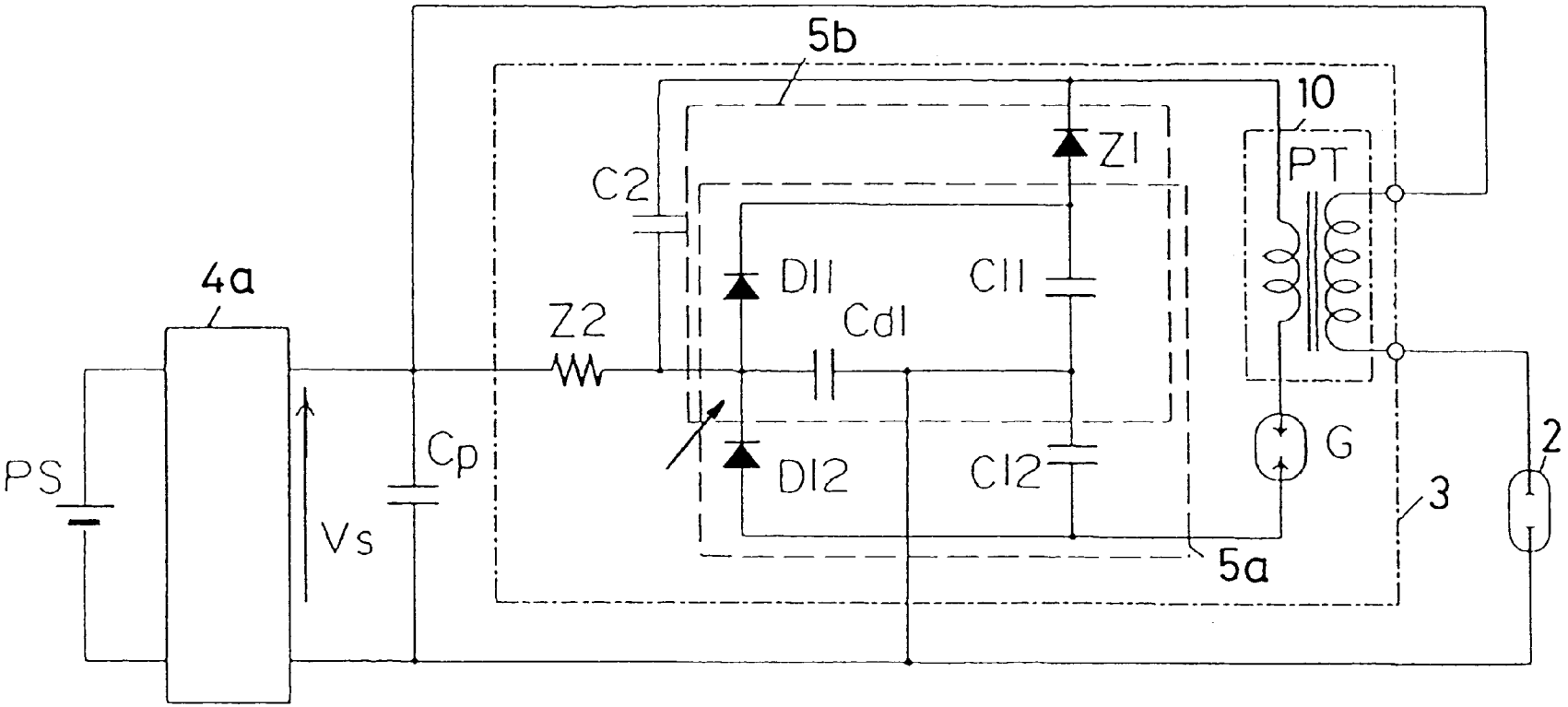
Figure 29A:
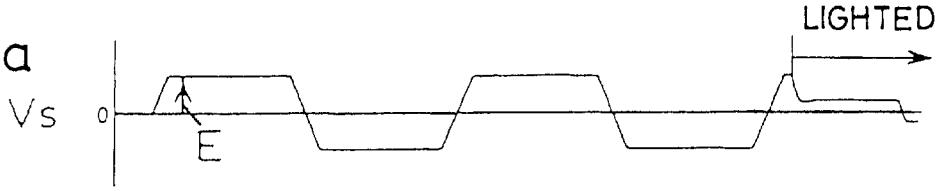
Figure 29B:
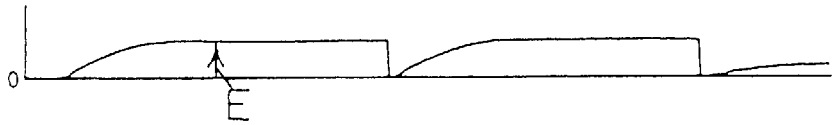
Figure 29C:
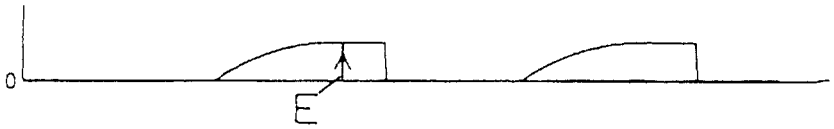
Figure 29D:
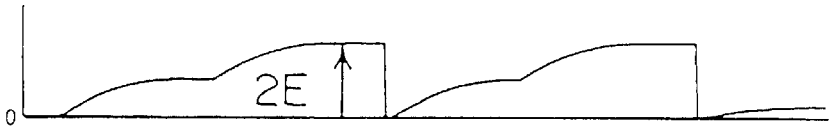
Figure 29E:
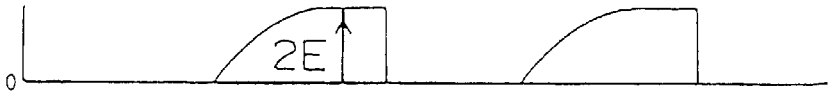
Figure 29F:
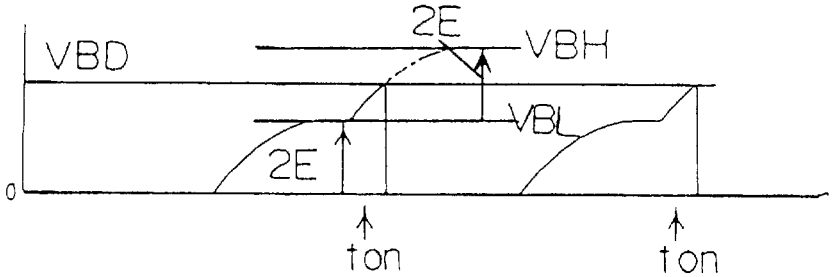
Figure 29G:
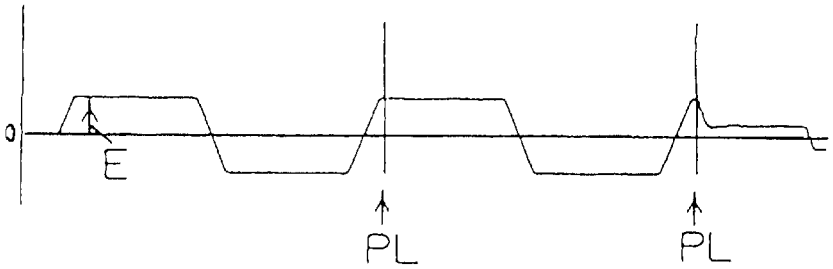

FIGS. 9*a*–9*c* are circuit diagrams showing examples of arrangements of the energy supply source means of FIG. 8;

FIGS. 10*a*–10*d* are circuit diagrams showing examples of arrangements of the trigger source means;

FIG. 11 is a circuit diagram of the pulse generator in an embodiment according to the present invention;

FIGS. 12*a*–12*d* are waveform diagrams for operational explanation of the circuit in FIG. 11;

FIG. 13 is a circuit diagram of the pulse generator in another embodiment according to the present invention;

FIGS. 14*a*–14*d* are explanatory waveform diagrams for the operation of the circuit of FIG. 13;

FIGS. 15–19 are circuit diagrams showing further embodiments respectively of the pulse generator according to the present invention;

FIGS. 20–22 are schematic circuit diagrams in still further basic arrangements respectively according to the present invention;

FIG. 23 is a circuit diagram showing still another embodiment of the generator according to the present invention;

FIGS. 24*a*–24*c* are explanatory waveform diagrams for the operation of the circuit of FIG. 23;

FIG. 25 is a circuit diagram showing another embodiment of the generator according to the present invention;

FIG. 26 is a circuit diagram showing another embodiment of the generator according to the present invention;

FIGS. 27*a*–27*g* are explanatory waveform diagrams for the operation of the circuit of FIG. 26;

FIG. 28 is a circuit diagram showing another embodiment of the generator according to the present invention;

FIGS. 29*a*–29*g* are explanatory waveform diagrams for the operation of the circuit of FIG. 28; and FIGS. 30–34 are circuit diagrams respectively showing other embodiments of the generator according to the present invention.

While the present invention shall now be described with reference to the respective embodiments shown in the drawings, the intention is not to limit the invention only to these embodiments but rather to include all alterations, modifications and equivalent arrangements possible within a scope of appended claims.

DETAILED DESCRIPTION OF THE PREFERRED EMBODIMENTS

Figure 1:
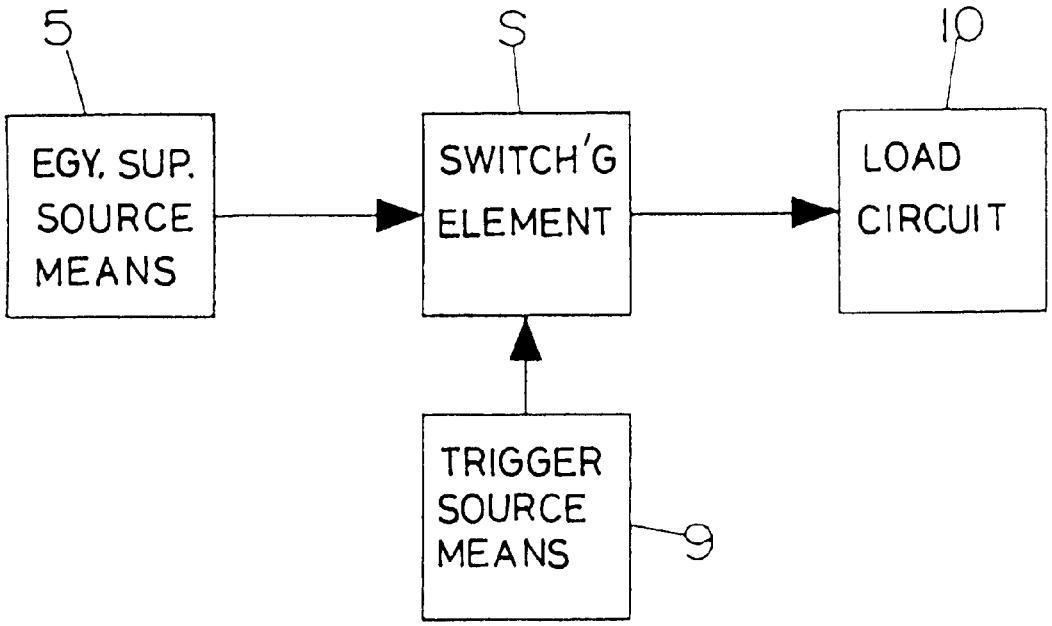
FIG. 1 is a block circuit diagram showing a basic concept of the pulse generator according to the present invention.

Referring first to the basic concept as well as its basic arrangement of the present invention, FIG.1 shows in the block diagram the basic concept of the pulse generator of the present invention. In the present instance, the pulse generator comprises an energy supply source means 5, a two-terminal voltage-responsive switching element S, a trigger source means 9 for triggering the switching elements S to turn it ON, and a load circuit 10 which generates a pulse with an energy supplied from the energy supply source means 5 upon turning ON of the switching element S.

In this arrangement, the switching element S is turned ON by the trigger source means 9 to have the energy supplied from the energy supply source means 5 to the load circuit 10, so that a generated pulse voltage is to be determined by the energy supply source means 5. That is, so long as the energy supplied by the energy supply source means 5 is of a predetermined value even if the ON voltage of the switching element S fluctuates, it is possible to have a predetermined pulse voltage generated, and the foregoing problems in the known devices can be eliminated.

Figure 2:
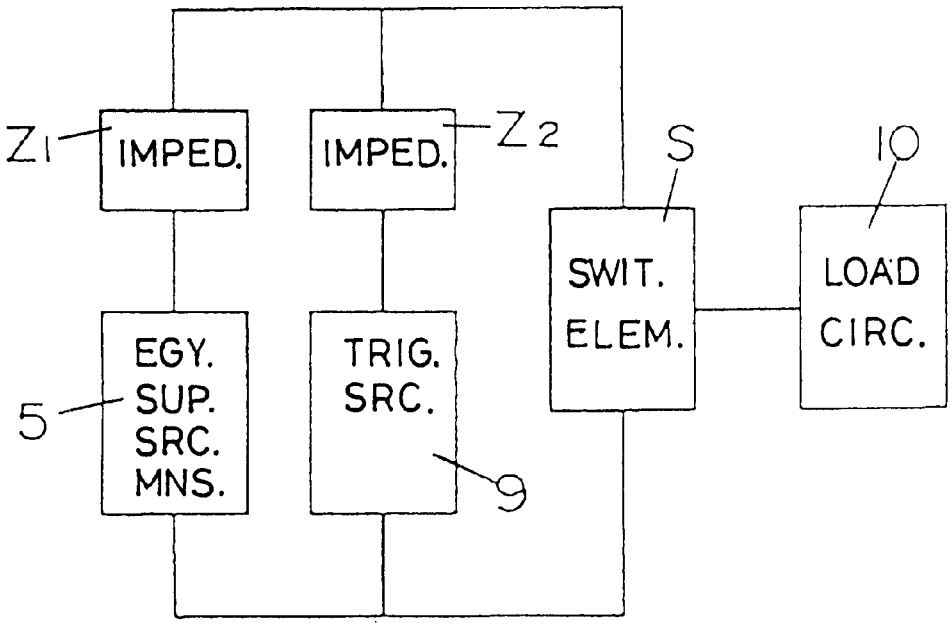
FIG. 2 is a block circuit diagram showing a basic arrangement in parallel system of the pulse generator according to the present invention.

For the switching element S, a gap element, a gas-charged gap element (air gap and gas gap) formed with a pair of opposing electrodes in an envelope charged with air or discharge-assisting gas, or two-terminal voltage-responsive semiconductor element is employed. The switching element is of such characteristics that the element is turned ON as the voltage across the element reaches a predetermined responsive voltage, to lower the impedance across the element, as a result of which the voltage across the element is lowered to allow a current to continuously flow therethrough, and the element turns OFF as this current becomes less than a predetermined holding current for the conducting state. Examples of the semiconductor switching element are a bi-directional diode thyristor, such PNPNP junction semiconductor referred to as SSS (such as a Sidac manufactured by SHINDENGEN-SHA) Shockley diode and the like. For practical basic arrangement, there may be provided a parallel arrangement and a series arrangement. FIG. 2 shows a parallel type example of the basic arrangement, in which a series circuit of the energy supply source means 5 and an impedance Z1 and a further series circuit of the trigger source means 9 and another impedance Z2 are connected in parallel to the switching element S and load circuit 10.

When the ON voltage of the switching element S is regarded as Vs here, its relationship to a voltage Ve1 of the energy supply source means 5 and a voltage Ve2 of the trigger source means 9 is set to be Ve1<Vs<Ve2. That is, the voltage Ve1 cannot turn ON the switching elements S but the voltage Ve2 generated turns ON the element S so that the energy of the energy supply source means 5 is supplied to the switching element S and load circuit 10.

The impedances Z1 and Z2 are so set as to have the circuit properly operated. That is, the current from the trigger source means 9 is made to flow to the switching element S and load circuit 10 when the voltage Ve2 causes the switching element S turned ON but, since the pulse voltage generated by the load circuit 10 is not stable as the voltage becomes ruling over the current from the trigger source means 9, the impedance Z2 is set normally to be larger than an impedance of the load circuit 10.

For this impedance Z2, it may be possible to employ a resistance element, capacitor element, inductance element, impedance element of non-linear characteristic or the like. Seemingly, it is possible to include part or the whole of the impedance Z2 in the trigger source means 9.

When, on the other hand, the voltage Ve2 is generated and applied to the switching element S, this voltage is to be absorbed by the energy supply source means 5 in the absence of the impedance Z1, and eventually the switching element S cannot be triggered. Thus, the impedance Z1 is set to be in a range of giving no remarkable influence on the pulse voltage generated at the load circuit 10.

Figure 3:
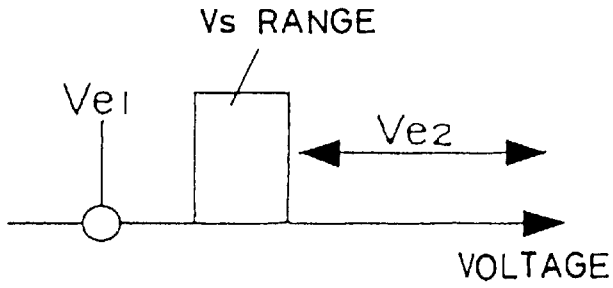
FIG. 3 is an operational explanatory view for the circuit of FIG. 2.

For the impedance Z1, here, it may be possible to employ a resistance element, capacitor element, inductance element, impedance element of non-linear characteristic or the like. Seemingly, the energy supply source means 5 may include part or the whole of the impedance Z1. Further, the impedance Z1 may even be including such switching means as a diode connected in forward direction to the energy supply source means 5. This is because the switching element S is in the OFF state before generation of the voltage Ve2, so that the particular diode is naturally not conducted, no energy is supplied from the energy supply source means 5 to the load circuit 10, and, even when the voltage Ve2 is generated, the diode is in non-conducted state since Ve1<Ve2. Therefore, the voltage Ve2 is applied to the switching elements S to render it to be ON but, simultaneously with the turning ON of the element S, the series circuit of the load circuit 10 and switching element S decreases its impedance, and the diode is made conductive to cause the energy of the energy supply source means 5 to be supplied to the load circuit 10. In FIG. 3, there is shown the relationship between the voltages Ve1, Vs and Ve2.

Figure 4:
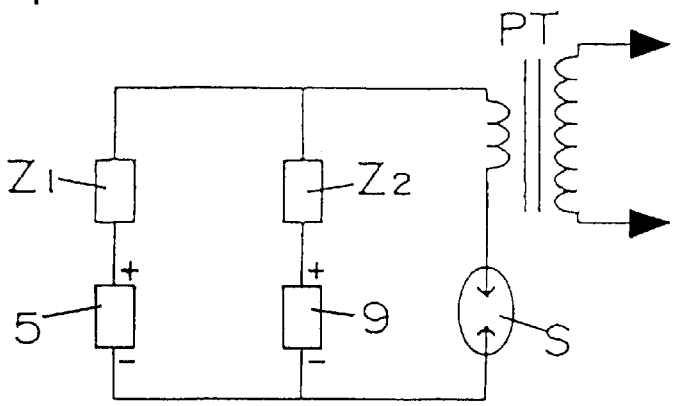
FIGS. 4 and 5 are circuit arrangements showing practical examples in other basic arrangement of the parallel system of the pulse generator according to the present invention.
Figure 5:
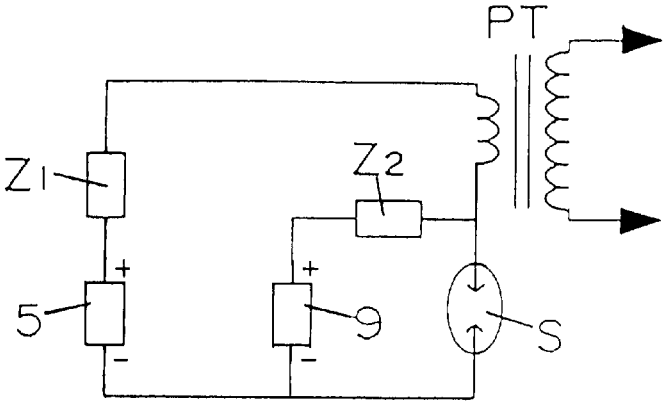

More concretely, a pulse transformer PT may be used as the load circuit. That is, as shown in FIG. 4, the switching element S is connected in series to a primary winding of the pulse transformer PT, so that the energy of the energy supply source means 5 will be supplied to the primary winding, and a pulse of a predetermined high voltage can be generated at a secondary winding of the pulse transformer PT. At this time, as shown in FIG. 5, the series circuit of the trigger source means 9 and impedance Z2 may be connected in parallel to the switching element S directly, not through the pulse transformer PT.

Figure 6:
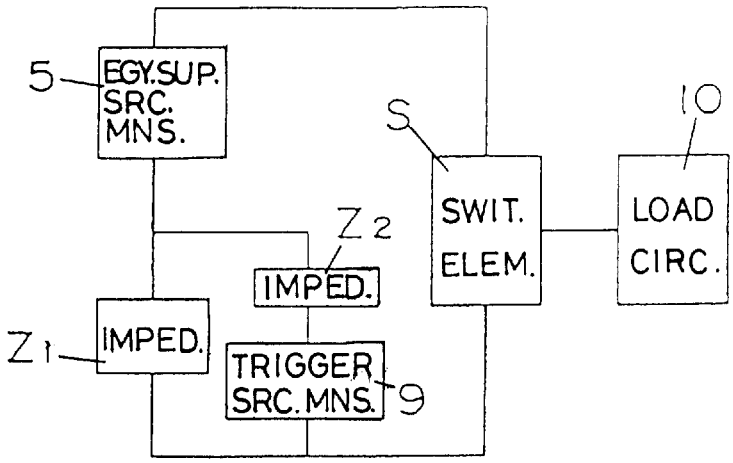
FIG. 6 is a block circuit diagram showing a basic arrangement in a series system of the pulse generator according to the present invention.

Referring next to the series arrangement, FIG. 6 shows an example of the series arrangement, in which the series circuit of the energy supply source means 5 and impedance Z1 is connected in parallel to the switching element S and load circuit 10, and the series circuit of the trigger source means 9 and impedance Z2 is connected in parallel to the impedance Z1. Further, in order that the energy supply path from the energy supply source means 5 to the load circuit 10 will not be influenced by the trigger source means 9 and impedance Z2, the impedance Z1 is connected equivalently in parallel to the series circuit of the trigger source means 9 and impedance Z2. The impedances Z1 and Z2 employed here may be of the same ones as those in the parallel arrangement.

Figure 7:
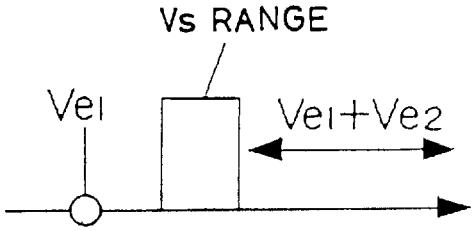
FIG. 7 is an operational explanatory diagram for the circuit of FIG. 6.

Assuming here that the ON voltage of the switching element S is Vs, the relationship thereof to the voltage Ve1 of the energy supply source means 5 and the voltage Ve2 of the trigger source means 9 is set to be Ve1<Vs<Ve1+Ve2, as shown in FIG. 7. That is, while the switching element S cannot be made ON with voltage Ve1, the switching element S is made ON when the voltage Ve2 is generated in addition to the voltage Ve1, and the energy of the energy supply source means 5 can be supplied to the circuit of the switching element S and load circuit 10. With this arrangement, the voltage Ve2 can be made lower than in the case of the parallel arrangement.

While in FIG. 8 a practical example in which the pulse transformer PT is used as the load circuit is shown, such arrangements as shown in FIGS. 9*a*–9*c* may be employed in this case as the energy supply source means 5. There may be employed in FIG. 9*a* a DC source voltage, in FIG. 9*b* by a commercial AC source voltage, and in FIG. 9*c* a pulse source voltage.

It is of course possible to employ any arrangement so long as the same is effective as means for allowing the required voltage Ve1 and energy for generating the desired pulse to be generated. In FIG. 9*b* or 9*c*, for example, the arrangement is made employable by passing momentarily the required voltage Ve1. That is, it suffices the purpose to turn the switching element S ON by having the voltage Ve2 generated at the time when the required voltage Ve1 is reached.

In the arrangements of FIG. 9, here, the combination of the impedance Z1 and energy supply source means 5 is not always inevitable but may be property modified. Further, the series or parallel relationship to the foregoing trigger source means 9 or impedance Z2 may also be properly selected.

Figure 10A:
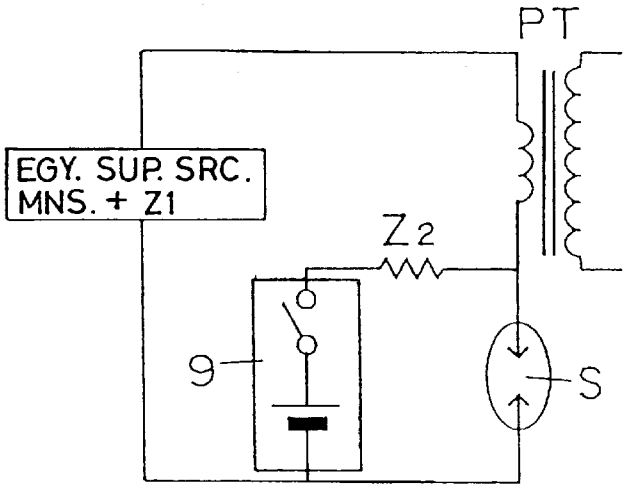
Figure 10B:
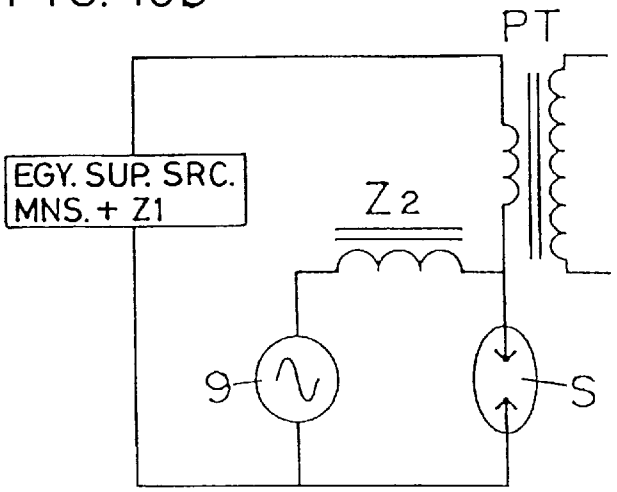
Figure 10C:
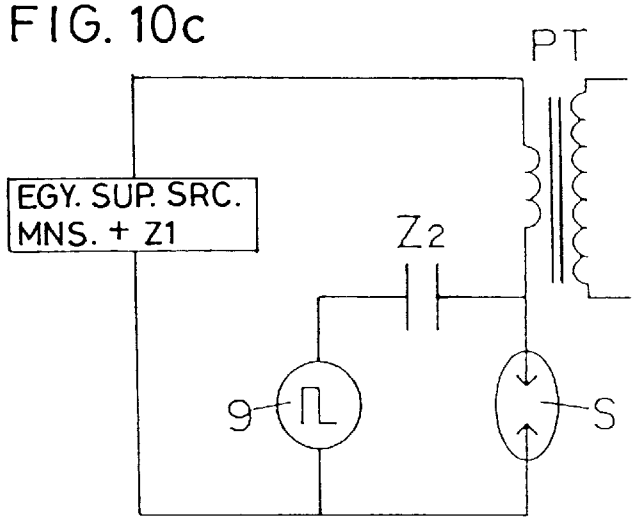
Figure 10D:
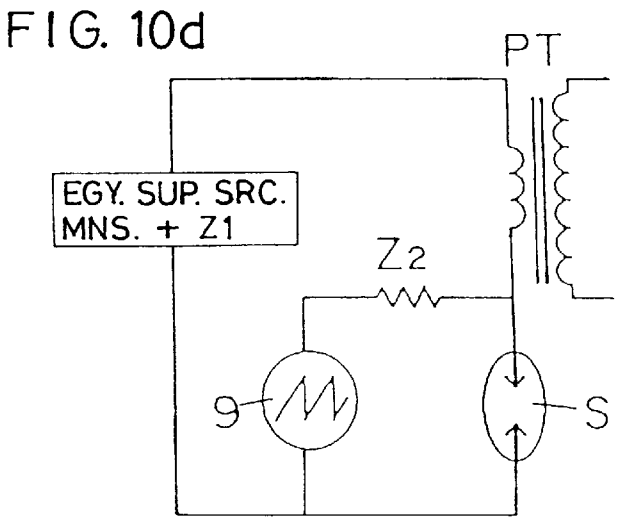

For the trigger source means 9, on the other hand, such arrangements as shown in FIGS. 10*a*–10*d* may be employed, and there may be used the DC source voltage in FIG. 10*a*, the commercial AC source voltage in FIG. 10*b*, the pulse source voltage in FIG. 10*c*, and a triangular wave voltage (a voltage of ramp wave or sawtooth wave) in FIG. 10*d*.

That is, as the trigger source means 9, it is possible to employ any means so long as the same allows the required voltage Ve2 for making ON the switching element S to be obtained and comprises an element which shows variation with time. Provided that the trigger source means 9 is the DC source which generates simply the voltage Ve2, for example, then the switching element S will be always in ON state, so that the pulse cannot be generated. Therefore, means which can generate the voltage Ve2 optionally or in accordance with time is to be employed.

In the drawings, the combination of the impedance Z2 and trigger source means 9 is not always inevitable, but may be combined properly. Further, the foregoing series or parallel relationship of the combination with respect to the energy supply source means 5 or impedance Z1 may properly be selected.

The present invention shall be described to details with reference to practical embodiments of the pulse generator employing the foregoing basic arrangements and the discharge lamp lighting device using the same.

The discharge lamp lighting device shown in FIG. 11 comprises the AC power source Vs, a ballast 4 connected to the AC power source Vs for supplying a power to the high voltage discharge lamp 2, and the pulse generator 3 as the igniter which is a starter of the high pressure discharge lamp 2.

The ballast 4 comprises a power factor improving capacitor Cf connected in parallel to the AC power source Vs, and a choke coil L inserted between the high pressure discharge lamp 2 and the AC source Vs, a by-pass capacitor Cp is connected to output side of the ballast 4, and a series circuit of the high pressure discharge lamp 2 and secondary winding PT of pulse transformer PT in the pulse generator 3 is connected in parallel to the by-pass capacitor Cp.

The pulse generator 3 is connected to the output side of the ballast 4, and is formed by connecting a primary winding PT1 of the pulse transformer PT in parallel through a discharge gap G to a secondary output side of a transformer T which boosts an output voltage of the ballast 4 to a turn-ratio times as large as an output voltage of the ballast 4 while connecting a capacitor C1 in parallel to the secondary output side, connecting in parallel a DC power source E2 to the discharge gap G through a series circuit of a switching element SW and a resistor R1 as an impedance element, and providing a voltage detecting circuit 7 for detecting a secondary voltage of the transformer T and a control circuit 6 for controlling the switching element SW on the basis of a detection voltage of the voltage detecting circuit 7. Here, the transformer T constitutes the energy supply source means 5, and the DC source E2 constitutes, together with the switching element SW, the trigger source means 9.

At this time, a secondary output voltage E1 of the transformer T is set to be below a discharge starting voltage $V_{Gon}$ of the discharge gap G, while the voltage of the DC source E2 is set to be above the discharge starting voltage $V_{Gon}$.

Next, the operation of the present embodiment shall be described with reference to the waveform diagrams of FIGS. 12*a*–12*d*.

Figures 12A, 12B, 12C, 12D:
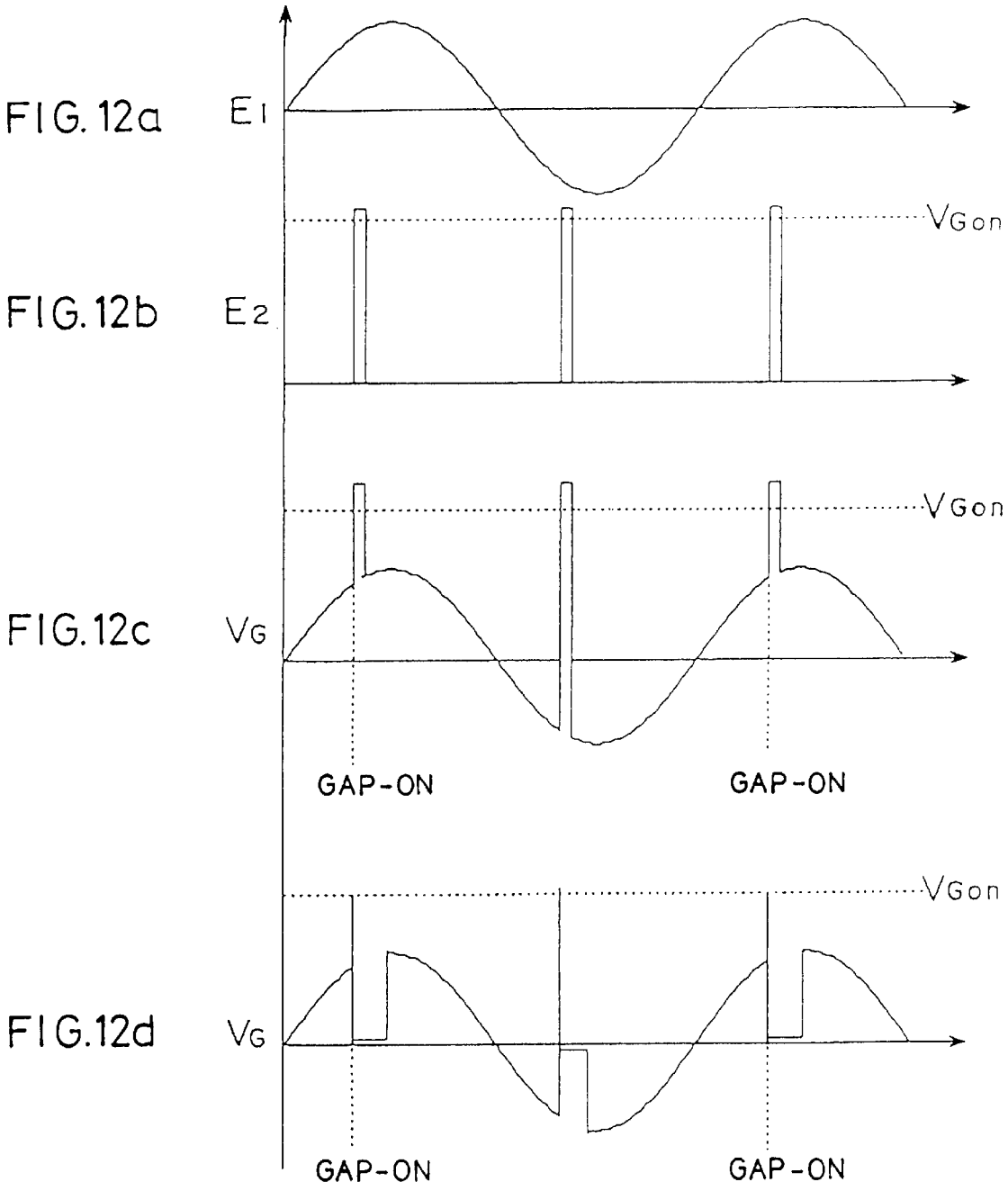

Now, as the source voltage of the AC power source Vs is applied, such voltage substantially the same as the AC source voltage Vs as shown in FIG. 12*a* is applied across the high pressure discharge lamp 2. At the same time, the voltage E2 boosted by the transformer T to be the turn-ratio times as large is applied across the discharge gap G, but the applied voltage in the initial period of the source connection does not reach the discharge starting voltage $V_{Gon}$ of the discharge gap G, so that discharge gap G does not operate, no starting pulse voltage is applied to the high pressure discharge lamp 2, and the lamp 2 does not start. Here, as the voltage detecting circuit 7 detects that the secondary voltage E1 of the transformer T has reached the predetermined voltage, the control circuit 6 turns the switching element SW ON, and a voltage higher than the discharge starting voltage $V_{Gon}$ of the discharge gap G (FIG. 12*b*) is caused to flow from the DC source E2 through the resistor R1.

As a result, the secondary voltage E2 of the transformer T and the DC source voltage E2 are applied across the discharge gap G in parallel relationship, and such voltage $V_G$ as shown in FIG. 12*c* is eventually applied. In this case, there is shown an image of the voltage $V_G$ when the discharge gap G is imagined not to perform the discharge. As the voltage $V_G$ across the gap exceeds the discharge starting voltage $V_{Gon}$, the discharge gap G turns ON to be substantially zero in the impedance, but turns OFF when the discharge current becomes zero.

Therefore, the voltage shown in FIG. 12*c* is applied to the discharge gap G to turn it ON upon reaching the discharge starting voltage $V_{Gon}$, an abrupt discharge current $I_P$ is caused to flow, but the gap G is turned OFF as the discharge current $I_P$ becomes zero, and the voltage across the discharge gap G will be as shown in FIG. 12*d*. As the discharge gap G turns ON and the current $I_P$ flows from secondary winding of the transformer T to the primary winding PT1 of the pulse transformer PT, a high voltage pulse is generated at the secondary winding PT2 of the pulse transformer PT2 and applied to the high pressure discharge lamp 2, whereby the lamp 2 is started to light, and the lighting is maintained with the power supplied from the ballast 4. The impedance connected in series to the energy supply source means 5 is obtained by means of the inductance of the secondary winding of the transformer T and the primary winding of the pulse transformer PT.

With the foregoing arrangement of the present embodiment, it is made possible to maintain the generated pulse voltage even when the discharge starting voltage $V_{Gon}$ of the discharge gap G varies, and to easily obtain the secondary output voltage E1 of the transformer T contributing to the pulse generation.

In another embodiment shown in FIG. 13, the discharge lamp lighting device is constituted by the AC power source Vs, the ballast 4 connected to the source Vs for supplying the power to the high pressure discharge lamp 2, and the pulse generator 3 as the igniter for starting the discharge lamp 2. The ballast 4 comprises the power factor improving capacitor Cf connected in parallel to the AC power source Vs, and the choke coil L inserted between the high pressure discharge lamp 2 and the AC source Vs, while the by-pass capacitor Cp is connected to the output side of the ballast 4, and the series circuit of the high pressure discharge lamp 2 and the secondary winding PT2 of the pulse transformer PT in the pulse generator 3 is connected in parallel to the by-pass capacitor Cp.

The pulse generator 3 is connected to the output side of the ballast 4, and is constituted by connecting a series circuit of the primary winding PT1 of the pulse transformer PT and a secondary winding PT2' of a triggering pulse transformer PT' in parallel, through the discharge gap G, connecting the capacitor C1 similarly in parallel, connecting to the DC power source Eb a series circuit of a primary winding PT1' of the pulse transformer PT' and a switching element Q2 consisting of a TRIAC, and providing the voltage detecting circuit 7 for detecting the secondary voltage of the transformer T and the control circuit 6 for controlling the switching element Q2 on the basis of the detection voltage of the voltage detecting circuit 7.

Here, the transformer T constitutes the energy supply source means 5; the DC source Eb, pulse transformer PT' and switching element Q2 constitute the trigger source means 9; the impedance connected in series to the energy supply source means 5 is constituted by the inductance of the secondary winding of the transformer T and primary winding PT1 of the pulse transformer PT; and the impedance connected in series to the trigger source means 9 is constituted by the inductance of the pulse transformer PT.

Further, the largest value of the secondary output voltage E1 of the transformer T is set to be below the discharge starting voltage $V_{Gon}$ of the discharge gap G, and a superposed voltage of a value adjacent to the largest value of the secondary output voltage E1 on the secondary output voltage E2 of the pulse transformer PT' is set to be above the discharge starting voltage $V_{Gon}$ of the discharge gap G.

Next, the operation of the present embodiment shall be described with reference to waveform diagrams shown in FIGS. 14*a*–14*d*.

Now, as the AC source voltage Vs is applied, substantially the same voltage as the source voltage Vs is applied across the high pressure discharge lamp 2 through the ballast 2 and the secondary winding PT2 of the pulse transformer PT. At the same time, the voltage E1 boosted to be turn-ratio times as large by the transformer T is applied across the discharge gap G, whereas the both end voltage $V_G$ at this time of the discharge gap G does not reach the discharge starting voltage $V_{Gon}$ of the discharge gap G, and the discharge gap G is not made ON.

Figures 14A, 14B, 14C, 14D:
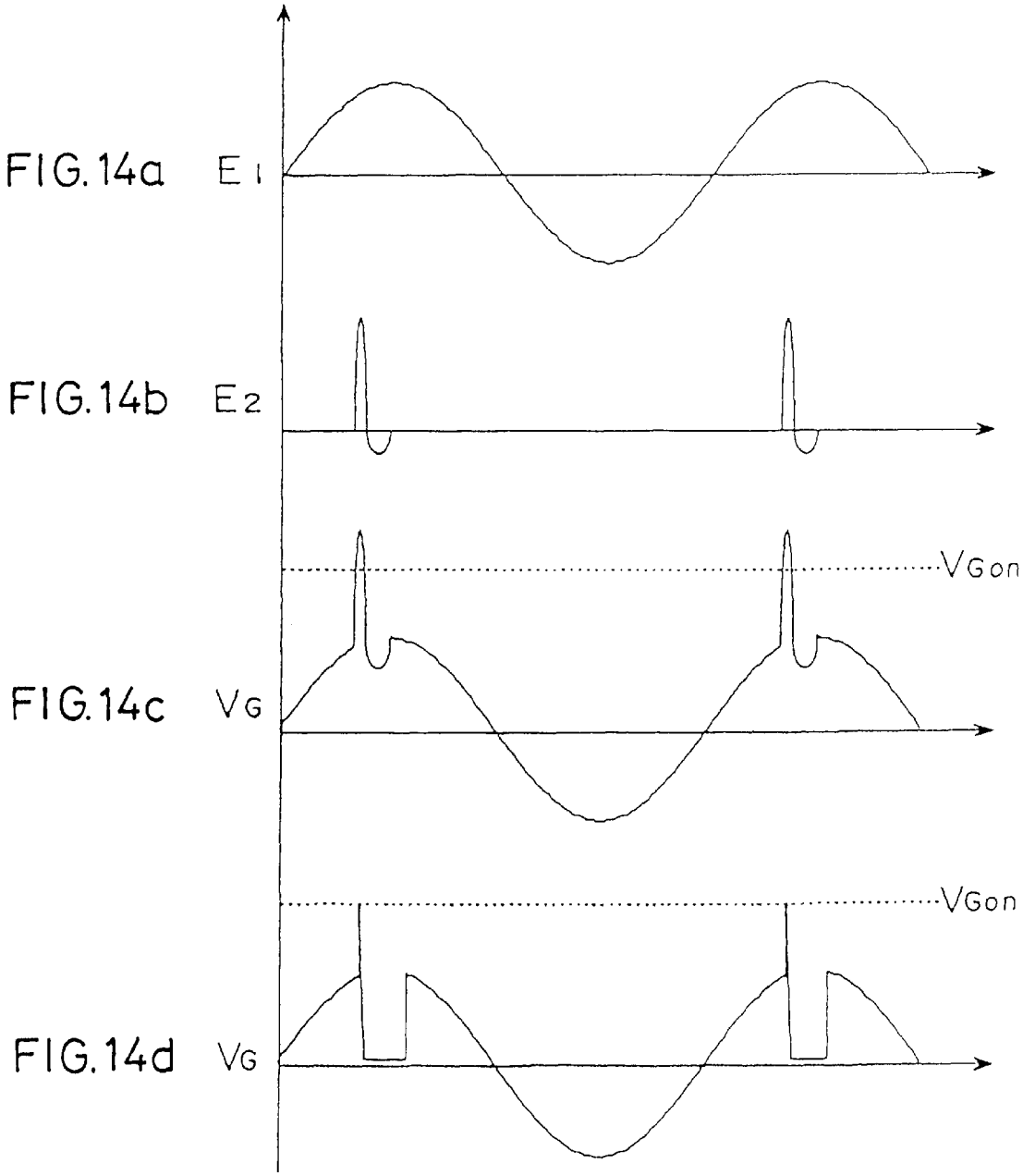

Here, as the voltage detecting circuit 7 detects that the secondary voltage E1 of the transformer T has reached the predetermined voltage, the control circuit 6 causes the switching element Q2 to be turned ON, consequent to which an abrupt current $I_P'$ flow through a closed loop of the DC power source Eb→primary winding of pulse transformer PT'→switching element Q2→DC power source Eb, and such pulse voltage E2 as shown in FIG. 14*b* is generated at the secondary winding PT2' of the pulse transformer PT'.

Because the secondary winding PT2' of the pulse transformer PT' is connected in series to the discharge gap G, the both end voltage of the discharge gap G will be a superposed voltage of both voltages E1 and E2 (FIG. 14*c* being a waveform diagram imaging a state in which the discharge gap is not made ON). As the voltage $V_G$ across the discharge gap G reaches the discharge starting voltage $V_{Gon}$, the discharge gap G turns ON to render its impedance to be zero, but, as the discharge current becomes zero, the impedance will be infinitive. Therefore, when the voltage $V_G$ exceeds the discharge starting voltage $V_{Gon}$ with the voltage shown in FIG. 14*c* added, the discharge gap G turns ON to cause the abrupt discharge current $I_P$ to flow to the primary winding PT1 of the pulse transformer PT, consequent to which a high voltage pulse is generated at the secondary winding PT2. As the discharge current $I_P$ becomes zero, the discharge gap G turns OFF, and thereafter the operation described is repeated. At this time, the both end voltage $V_G$ of the discharge gap G will be as shown in FIG. 14*d*.

The high voltage pulse thus generated at the secondary winding PT2 of the pulse transformer PT with the above operation is applied to the high pressure discharge lamp 2 to start it, a power is supplied from the ballast 4, and the lighting thus started is maintained.

With the foregoing arrangement, the present embodiment makes it possible to maintain the generated pulse voltage even when the discharge starting voltage $V_{Gon}$ of the discharge gap G varies. As the voltages E1 and E2 are applied to the discharge gap G as superposed on each other, the voltage E2 can be restrained to be low.

Other than the pulse generator 8 as referred to in the respective embodiments of the foregoing discharge lamp lighting device, on the other hand, such ones as will be described with reference to following embodiments can be employed as the pulse generator 8.

Figure 15:
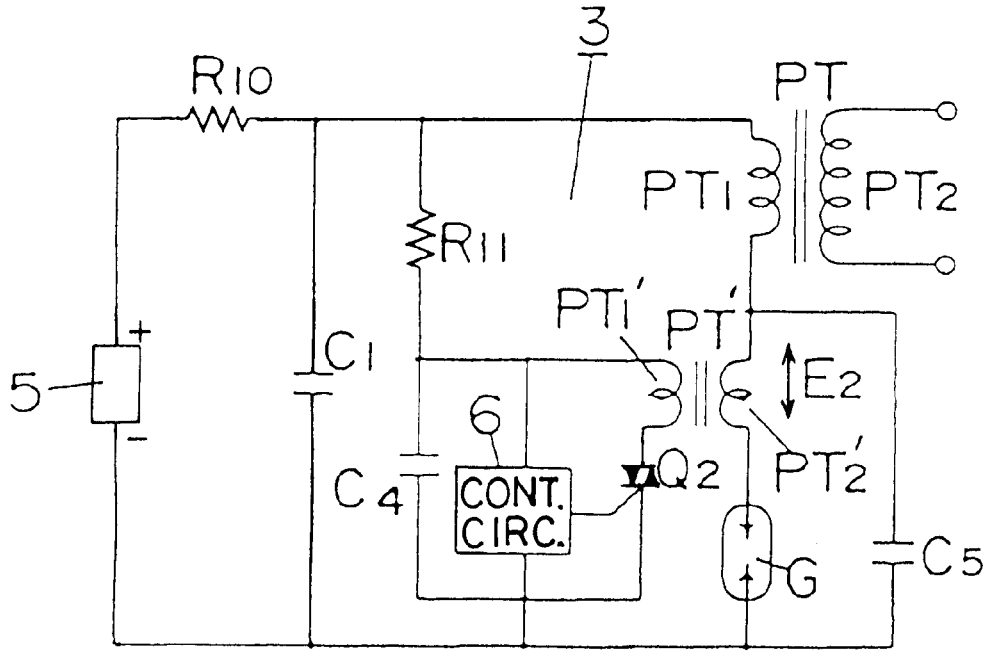

In an embodiment shown in FIG. 15, the capacitor C1 is connected in parallel, through a resistor R10, to the energy supply source means 5, the discharge gap G is connected in parallel, through the primary winding PT1 of the pulse transformer PT and the secondary winding PT2' of the triggering pulse transformer PT', to the capacitor C1, and a series circuit of a resistor R11 and a capacitor C4 is also connected in parallel to the capacitor C1.

To the capacitor C4, a series circuit of the primary winding PT1' of the pulse transformer PT' and switching element Q2 is connected, and the control circuit 6 for controlling the switching element Q2 is also connected. To the series circuit of the secondary winding PT2' of the pulse transformer PT' and the discharge gap G, a capacitor C5 is connected in parallel.

Here, the capacitor C5 is set to be smaller in the capacity than the capacitor C1, and the trigger source means is constituted by the secondary winding PT2' of the pulse transformer PT' and capacitor C5. Thus, the capacitor C5 is charged with the energy from the energy supply source means 5 through the resistor R10 and primary winding PT1 of the pulse transformer PT, and a voltage thereof is applied through the secondary winding PT2' of the pulse transformer PT' to both ends of the discharge gap G, upon which the voltage is at a level not enough for turning ON the discharge gap G.

When the switching element Q2 is made ON, next, there occurs a pulse voltage at the secondary winding PT2' of the pulse transformer PT', and this pulse voltage is superposed on a voltage at the capacitor C5, so that the voltage $V_G$ across the discharge gap G will reach the discharge starting voltage $V_{Gon}$. Consequently, there flows a current from the capacitor C5, but no current flows to the pulse transformer PT. Therefore, the energy flows from the energy supply source means 5 to the primary winding PT1 of the pulse transformer PT, so that an influence occurring upon generation of the pulse voltage at the pulse transformer PT can be minimized.

Figure 16:
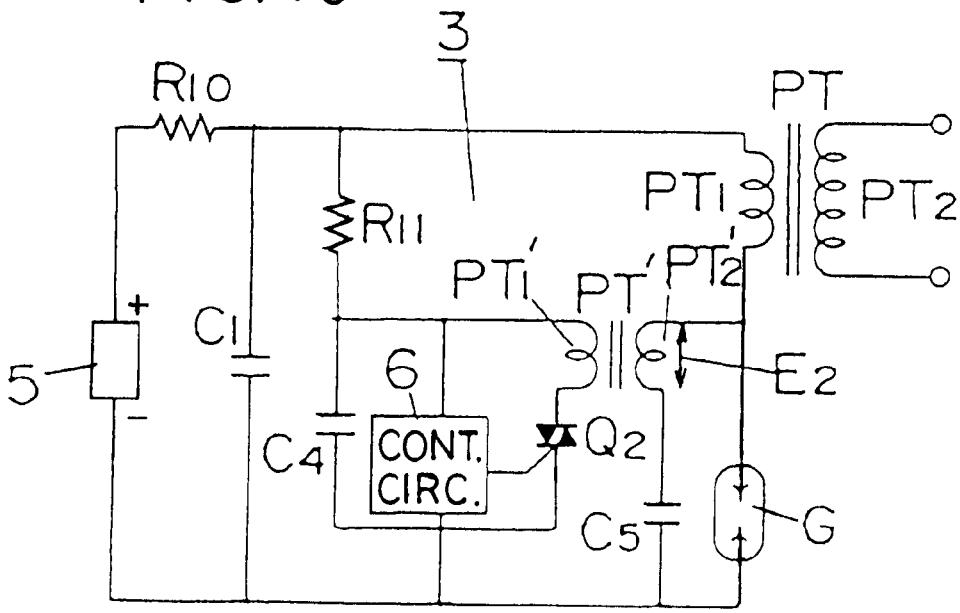

In another embodiment shown in FIG. 16, the pulse generator 3 differs from the generator 3 in the foregoing embodiment shown in FIG. 13 in respect that a series circuit of the capacitor C5 and secondary winding PT2' of the triggering pulse transformer PT' is connected in parallel to the discharge gap G. Here, the capacitor C5 may be smaller in the capacity than the capacitor C1. In this case, the voltage of the capacitor C5 is charged to be substantially equal to that of the capacitor C1 up to the generation of the pulse voltage at the secondary winding PT2' of the pulse transformer PT' upon turning ON of the switching element Q2. As the pulse voltage is generated at the secondary winding PT2' of the pulse transformer PT', this pulse voltage and the voltage at the capacitor C5 are superposed on each other and are applied to the discharge gap G to turn it ON.

According to the present embodiment, the secondary winding PT2' of the triggering pulse transformer PT' is not interposed in the current path from the energy supply source means 5 to the primary winding PT1 of the pulse transformer PT and the discharge gap G, and it is enabled to supply a higher energy to the primary side of the pulse transformer PT and to elevate the output pulse voltage.

Figure 17:
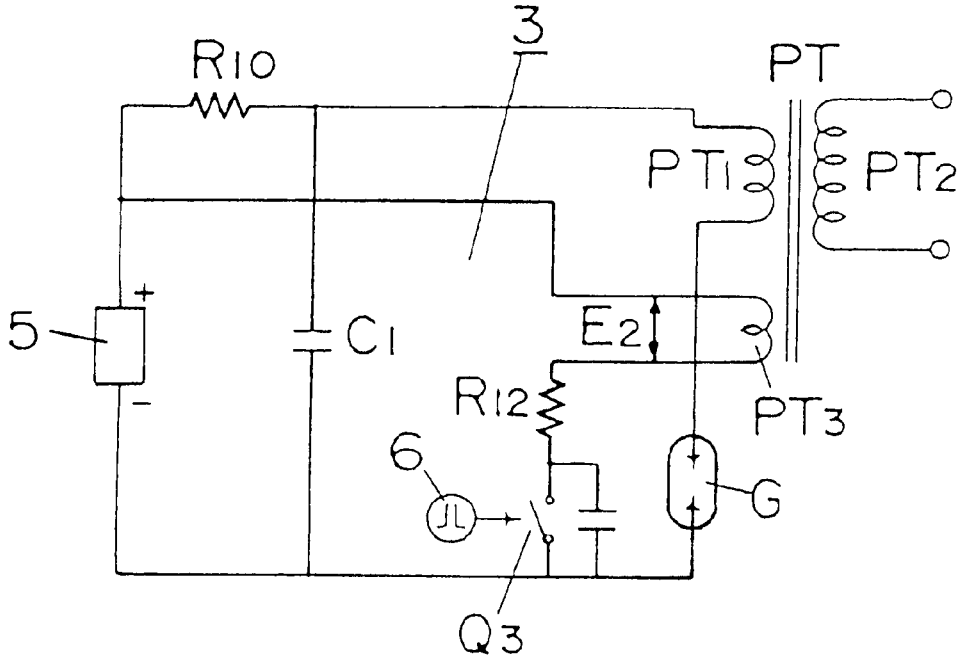

In a further embodiment shown in FIG. 17, the pulse transformer PT is provided with a tertiary winding PT3, a series circuit of this tertiary winding PT3, a resistor R12 and a switching element Q3 is connected to the energy supply source means 5, and a trigger voltage is generated at the primary winding PT1 through a transformer action caused by turning the switching element Q3 ON with the control circuit 6 and, upon which ON, rendering a current to flow to the tertiary winding PT3. This trigger voltage is applied to the discharge gap G as superposed on the voltage at the capacitor C1, to have the discharge gap G turned ON. That is, the voltages generated at the capacitor C1 and at the primary winding PT1 of the pulse transformer PT with the current flowing through the tertiary winding PT3 are acting substantially as the trigger source means 9. Further, the present embodiment needs not be separately provided with the triggering pulse transformer.

Figure 18:
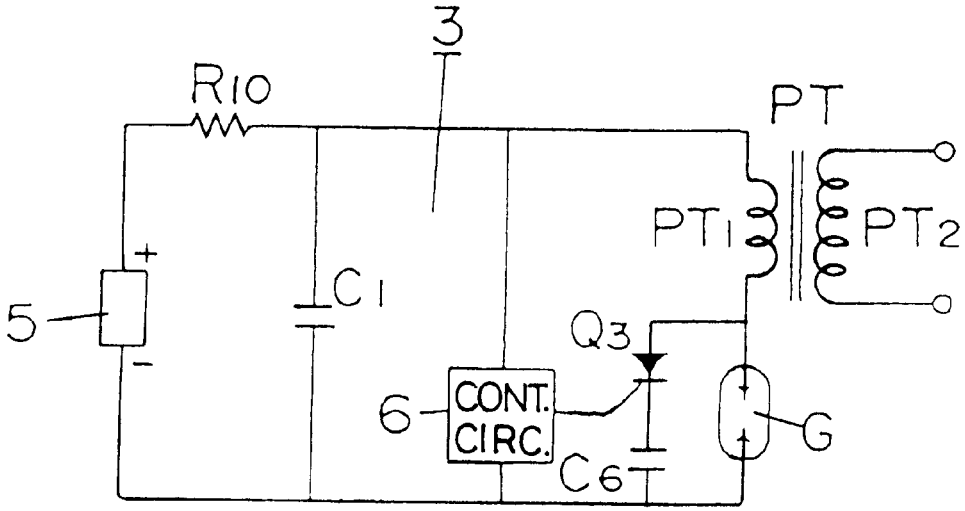

In another embodiment shown in FIG. 18, the discharge gap G is connected in parallel to the capacitor C1 through the primary winding PT1 of the pulse transformer PT, a series circuit of the switching element Q3 comprising a thyristor and a capacitor C6 is connected to the discharge gap G, and the control circuit 6 for controlling the switching element Q3 is connected in parallel to the capacitor C1.

Now, as the control circuit 6 causes the switching element Q3 turned ON, a current is made to flow to the capacitor C6 from the energy supply source means 5 and capacitor C1 through the primary winding PT1 of the pulse transformer PT. This current is a resonance current due to the inductance of the primary winding PT1 of the pulse transformer PT and the capacitor C6, and a voltage about twice as high as the voltage of the energy supply source means 5 is generated at the capacitor C6. With this voltage, the discharge gap G is made ON. That is, this resonance circuit constitutes the trigger source means.

Here, the capacitor C1 is set to have a sufficiently larger capacity than the capacitor C6, so that the capacity of the capacitor C1 will not participate in the resonance of the capacitor C6 to the inductance of the primary winding PT1 of the pulse transformer PT.

In the present embodiment, therefore, required number of parts can be further reduced than in the case of the foregoing embodiments of FIGS. 15–17.

Figure 19:
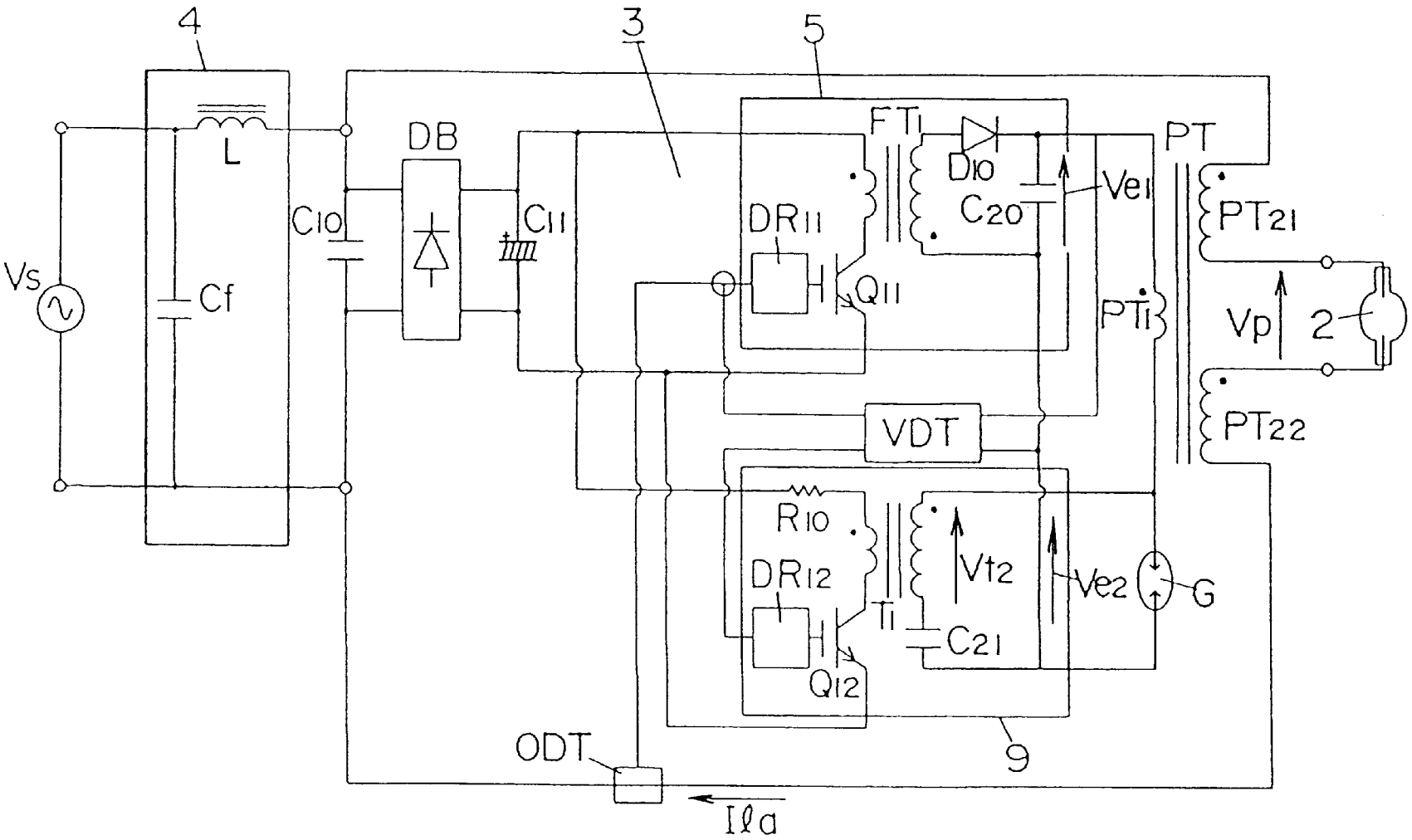

In another embodiment shown in FIG. 19, a discharge lamp lighting device is constituted by the AC power source Vs, ballast 4 connected to the AC source Vs for supplying a power to the high pressure discharge lamp 2, and the pulse generator 3 as the igniter for starting the high pressure discharge lamp 2. In the present case, the ballast 4 comprises the power factor improving capacitor Cf connected in parallel to the AC source Vs, a choke coil L inserted between the high pressure discharge lamp 2 and the AC source Vs or the like, a series circuit of the first secondary winding PT21 of the pulse transformer PT, high pressure discharge lamp 2 and second secondary winding PT22 of the pulse transformer PT is connected, through a lighting detection means ODT of the pulse generator 3, to the output side of the ballast 4, and a capacitor C10 is connected in parallel also to the output side.

The pulse generator 3 comprises the pulse transformer PT, a rectifying smoothing circuit including a full-wave rectifier DB and smoothing capacitor C11, the energy supply source means 5 operating with the rectifying smoothing circuit used as a power source, discharge gap G connected through the primary winding PT1 of the pulse transformer PT to the output side of the energy supply source means 5, the trigger source means 9 operating with the rectifying smoothing circuit made as the power source and connected at output side of the means to the discharge gap G, lighting detection means ODT inserted between the high pressure discharge lamp 2 and an end of the ballast 4 for detecting a lamp current Il*a* of the high pressure discharge lamp 2 to determine its lighting or non-lighting, and a voltage detecting means VDT for detecting output voltage of the energy supply source 5.

Here, the energy supply source means 5 comprises a fly-back transformer FT1, such high speed switching element Q11 as IGBT or the like, diode D10, capacitor C20, and a driving circuit DR11 for generating a train of high speed driving signals for the switching element Q11, in which the switching element Q11 is connected through a primary winding of the fly-back transformer FT1 to the smoothing circuit C11, the capacitor C20 is connected through the diode D10 to a secondary winding of the fly-back transformer FT1, and the driving circuit DR11 operates as controlled by detection outputs of the voltage detecting means VDT and lighting detection means ODT. Both ends of the capacitor C20 form an output end of the energy supply source means 5, to which a series circuit of the primary winding PT1 of the pulse transformer PT and discharge gap G is connected.

The trigger source means 9 comprises a boosting transformer T1, such high speed switching element Q12 as IGBT or the like, capacitor C21, driving circuit DR12 for generating a train of high speed driving signals for the switching element Q12, and resistor R10, wherein the switching element Q12 is connected through the resistor R10 and primary winding of the transformer T1 to the smoothing capacitor C11, the capacitor C21 is connected in series to secondary winding of the transformer T1, and the driving circuit DR12 operates as controlled by the detection output of the voltage detecting means VDT. Both ends of a series circuit of the secondary winding of the transformer T1 and capacitor C21 are forming an output end of the trigger source means 9, to which output end the discharge gap G is connected.

Referring next to the operation of the present embodiment, the connection of the AC power source Vs causes the AC power Vs to be applied across the high pressure discharge lamp 2 through the ballast 4, first and second secondary windings PT21 and PT22 of the pulse transformer PT and lighting detection means ODT. An AC voltage is generated at the capacitor C10 through the ballast 4, which voltage is rectified at the full-wave rectifier DB and smoothed at the smoothing capacitor C11, and a DC voltage is obtained. At the energy supply source means 5, an AC voltage is caused to be generated at the fly-back transformer FT1 from the voltage of the capacitor C11 with the switching element Q11 operated, and this AC voltage is rectified by the diode D10 to accumulate in the capacitor C20 an eventual pulse generating energy desired.

Here, the energy supply source means 5 constitutes a normal fly-back converter.

In this way, a voltage Ve1 is generated with the eventual pulse generating energy accumulated in the capacitor C20, upon which the voltage Ve1 across the capacitor C20 is also accumulated in the capacitor C21 in the trigger source means 9 through the primary winding PT1 of the pulse transformer PT and the secondary winding of the boosting transformer T1 in the means 9, whereas, in the present embodiment, the capacitor C20 is set to be larger in the capacity than the capacitor C21, and an accumulated energy in the capacitor C21 is made sufficiently smaller than that in the capacitor C20.

Here, as the voltage E1 of the capacitor C20 reaches a predetermined voltage, such voltage is detected by the voltage detecting means VDT, and the driving circuit DR11 stops its operation, whereby the voltage Ve1 of the capacitor C20 is prevented from reaching the predetermined voltage. Simultaneously with the above stop of the driving circuit DR11 by a detection signal of the voltage detecting means VDT or as delayed therefrom, a signal is provided to the trigger source means 9. That is, this signal is transmitted to the driving circuit DR12 of the trigger source means 9 to turn the switching element Q12 ON, whereby a voltage substantially equal to the voltage of the smoothing capacitor C11 is applied from the smoothing capacitor C11 through the resistor R10 to the primary winding of the boosting transformer T1. Accordingly, there is generated a voltage Vt2 at the secondary winding of the boosting transformer T1.

In the capacitor C21, a voltage substnatially equal to the voltage Ve1 is accumulated, and a sum voltage Ve2 of Ve1 to which Vt2 is added is applied across the discharge gap G. As the voltage Ve2 is made thereby to reach the discharge starting voltage $V_{Gon}$ of the discharge gap G, the gap is made ON, an energy of the capacitor C20 is supplied to the primary winding PT1 of the pulse transformer PT, and a high voltage pulse $V_P$ required for starting the high pressure discharge lamp 2 is generated between the first and second secondary windings PT21 and PT22 of the pulse transformer PT.

Consequently, the high pressure discharge lamp 2 starts discharging, the current Il*a* is caused to flow from the AC power source Vs through the ballast 4 to the lamp 2 for its lighting. Since the lighting detection circuit ODT detects the lamp current Il*a* and operates to stop the driving circuit DR11 when the high pressure discharge lamp 2 is in the lighting state, it is made possible to prevent any unnecessary pulse from being generated during lighting state of the lamp 2.

The arrangement in the present embodiment of the energy supply source means 5, trigger source means 9 and series connected impedance (corresponding to the foregoing impedance Z1 and Z2) is forming the parallel type. Here, it should be appreciated that, according to the present embodiment, even the discharge lamp-use igniter employing the discharge gap G is enabled to be very highly stable in the output pulse voltage, and eventually the device can be minimized in the costs and size while improving the device in the safety.

In another embodiment shown in FIG. 20, there are provided first and second rectifying circuits 5*a* and 5*b* for boosting and rectifying (voltage doubling or n-times rectification) the AC source voltage Vs, and the capacitors C1 and C2 are connected respectively between output terminals of each of the rectifying circuits 5*a* and 5*b*. The AC power source Vs may be any of such waveforms as square wave, sinusoidal wave and so on. For the respective capacitors C1 and C2, the impedance elements Z1 and Z2 are respectively connected in series, and respective series circuits of the capacitors C1 and C2 and impedance elements Z1 and Z2 are connected mutually in parallel. To this parallel circuit, a series circuit of the load circuit 10 and discharge gap G is connected.

Here, an output voltage of the rectifying circuit 5*a* is so set as to render a voltage across the capacitor C1 to be lower than a breakdown voltage of the discharge gap G, while an output voltage of the rectifying circuit 5*b* is so set as to render a voltage across the capacitor C2 to be sufficiently higher than the breakdown voltage of the discharge gap G.

Further, the impedance of the impedance element Z2 is set to be sufficiently larger than the load circuit 10, and a voltage across the capacitor C2 is provided so as almost not to be applied to the load circuit 10 upon conduction of the discharge gap G. It is also possible to enlarge the impedance equivalently by rendering the capacity of the capacitor C2 to be smaller, to attain the same function as an event when the impedance element is made larger.

On the other hand, the impedance element Z1 is so set that a charge current according to a difference between voltages across the capacitors C1 and C2 will be prevented from flowing to the capacitor C1 and a discharge current of the capacitor C1 will be allowed to sufficiently flow to the load circuit 10. A practical example of the impedance element Z1 of the kind referred to shall be explained with reference to a later described embodiment. Here, it suffices the purpose that a diode inserted with a polarity allowing the discharge current of the capacitor C1 to flow therethrough is imagined for the impedance element Z1, a resistor is imagined for the impedance element Z2, and a pulse transformer is imagined for the load circuit 10. Other impedance elements Z1 and Z2 shall be described later.

Now, as the voltage across the capacitor C2 and the voltage applied through the impedance element Z2 and load circuit 10 to the discharge gap G reaches the breakdown voltage, then the discharge gap G is made conductive. At this time, the impedance of the discharge gap G is the infinity up to the conduction thereof, and the voltage across the capacitor C2 is applied to the discharge gap G since the impedance element Z1 is blocking the charge current to the capacitor C1.

As the discharge gap G conducts, on the other hand, the capacitor C2 is discharged through the impedance element Z2 and load circuit 10. Here, the impedance element Z2 is sufficiently larger in the impedance than the load circuit 10, so that the voltage applied to the load circuit 10 is small, and the voltage across the capacitor C2 gives almost no influence on the load circuit 10. Accompanying the conduction of the discharge gap G, the capacitor C1 is also discharged through the impedance element Z1, and the voltage across the capacitor C1 is to be applied to the load circuit 10. That is, so long as the voltage across the capacitor C1 is constant, the voltage applied to the load circuit 10 will be also constant.

As has been described, the voltage higher than the breakdown voltage is applied to the discharge gap G in order that the gap conducts, but the arrangement is so made that, upon conduction of the discharge gap G, the applied voltage should give almost no influence on the load circuit 10. After the conduction of the discharge gap G, in addition, a voltage lower than the breakdown voltage of the discharge gap G is applied to the series circuit of the load circuit 10 and discharge gap G, so that a constant voltage can be applied to the load circuit 10 while the conducting state of the discharge gap G continues.

In another embodiment shown in FIG. 21, the device is so constituted that the capacitors C1 and C2 connected between the output terminals of the rectifying circuits 5*a* and 5*b* are mutually connected in series, the capacitor C1 is connected through the impedance element Z1 to the series circuit of the load circuit 10 and discharge gap G, and the series circuit of the load circuit 10 and discharge gap G is connected through the impedance element Z2 to the series circuit of the capacitors C1 and C2.

In this arrangement, the voltage across the capacitor C1 is set to be lower than the breakdown voltage of the discharge gap G, and a voltage across the series circuit of the capacitors C1 and C2 is set to be higher than the breakdown voltage of the discharge gap G. Other parts are the same as those in the arrangement of FIG. 20, which are denoted by the same reference codes as in FIG. 20 and are functioning in the same manner.

Therefore, as the voltage across the series circuit of the capacitors C1 and C2 reaches the breakdown voltage of the discharge gap G, the gap conducts. Since the impedance element Z2 has an impedance sufficiently larger than the load circuit 10, the voltage across the series circuit of the capacitors C1 and C2 gives almost no influence on the load circuit 10 upon conduction of the discharge gap G. Since the conduction of the discharge gap G causes the capacitor C1 to be discharged, the voltage across the capacitor C1 is applied to the load circuit 10, and the voltage applied to the load circuit 10 is rendered to be substantially constant.

As a result, substnatially the same operation as that of FIG. 20 can be attained also with the present arrangement.

In another embodiment shown in FIG. 22, the capacitor C2 is charged with an output voltage of the rectifying circuit 5*b*, and the voltage for conducting the discharge gap G is obtained by a sum voltage of the capacitor C2 and AC power source Vs. Therefore, the device employs an arrangement in which a series circuit of the primary winding of the pulse transformer PT is connected across a series circuit of the AC power source Vs, capacitor C2 and impedance element Z2. Other parts and the operation are the same as those in the arrangement of FIG. 20.

In the arrangement of the present embodiment, the pulse transformer PT is employed as the load circuit 10, a diodo connected in a polarity allowing the discharge current to flow from the capacitor C1 to the primary winding of the pulse transformer PT is employed as the impedance element Z1, and a resistor is employed as the impedance element Z2, so as to be advantageous as the pulse generator.

In another embodiment shown in FIG. 23, the device is constituted with a voltage doubler rectifier employed as the rectifying circuit 5*a*, a voltage quadruplicater rectifier employed as the rectifying circuit 5*b*, a diode and resistor employed as the impedance elements Z1 and Z2 respectively, and the pulse transformer PT employed as the load circuit 10. That is, in the arrangement of FIG. 20, the rectifying circuits 5*a* and 5*b* respectively comprise the voltage doubler rectifier and voltage quadruplicater rectifier, respectively.

For the diecharge gap G, one available as FS08X-1 by SIEMENS is employable, and the breakdown voltage of the discharge gap G is made to fluctuate in a range of 680V to 1000V. Here, the voltage of AC source Vs is made 300V, for example, then the output voltage of the rectifying circuit 5*a* will be 600V, and the output voltage of the rectifying circuit 5*b* will be 1200V.

With such voltage relationship, the discharge gap G conducts as the voltage across the capacitor C2 rises but, as the resistor Z2 is sufficiently larger than the impedance of the pulse transformer PT, the voltage of the capacitor C2 is almost not applied to the primary winding of the pulse transformer PT. Further, upon conduction of the discharge gap G, the charge in the capacitor C1 is discharged through the diode Z1 and primary winding of the pulse transformer PT, upon which a pulse of high voltage is provided at the secondary winding of the pulse transformer PT.

As the discharge currents of the capacitors C1 and C2 become less than a predetermined current, the discharge gap G is made non-conductive, and the capacitors C1 and C2 are charged again. That is, provided that the AC power source Vs provides such square wave voltage as shown in FIG. 24*a* and having a peak voltage E, the voltages across the capacitors C1 and C2 will vary as in FIGS. 24*b* and 24*c*. Provided further that the breakdown voltage of the discharge gap G fluctuates between an upper limit value VBH and a lower limit value VBL and the discharge gap G is to be ON (at time ton in the illustrated example) when the voltage across the capacitor C2 has reached a value VBD (VBH>VBD>VBL), the capacitor C1 is also discharged at this timing, and the voltages across the capacitors C1 and C2 will be zero. Unless the circuit operation is not stopped, thereafter, they are charged again to repeat the operation.

As has been described, in the present embodiment, a saturation voltage (=2E) of the voltage across the capacitor C1 is set to be lower than the lower limit value of the breakdown voltage of the discharge gap G, while a saturation voltage (=4E) of the voltage across the capacitor C2 is set to be higher than the upper limit of the breakdown voltage of the discharge gap G. Further, the arrangement is so made that the time when the voltage across the capacitor C2 reaches the lower limit value of the breakdown voltage of the discharge gap G is later than a time (ta in the illustrated example) at which the voltage across the capacitor C1 saturates. As a result, it is enabled to apply a substantially constant voltage to the primary winding of the pulse transformer PT irrespective of the fluctuation in the breakdown voltage of the discharge gap G, and to have a pulse voltage of a substantially constant voltage generated at the secondary winding of the pulse transformer PT. Other parts and operation are the same as those in the case of FIG. 20.

In another embodiment shown in FIG. 25, the rectifying circuit 5*a* comprising the voltage doubler rectifier is connected through the resistor Z2 to the AC power source Vs, the rectifying circuit 5*b* comprising a voltage trebler rectifier is constituted by using the capacitor C1 connected across output terminals of the rectifying circuit 5*a* and the diode Z1 connected in series to the capacitor C1 in conjunction with the rectifying circuit 5*a*, and a series circuit of the capacitor C2, resistor Z2 and AC source Vs is connected across output terminals of the rectifying circuit 5*b*. Further, a series circuit of the primary winding of the pulse transformer PT and discharge gap G is connected across the series circuit of the capacitor C1 and diode Z1. That is, part of the voltage trebler rectifier forming the rectifying circuit 5*b* is employed as the rectifying circuit 5*a*.

In this arrangement, the upper limit value of the voltage across the capacitor C1 becomes twice as high as the peak value of the AC source Vs while the upper limit value of the voltage across the capacitor C2 becomes treble as high as the peak value of the AC source Vs, so that, as the polarity of the AC source Vs is inverted after the capacitor C2 is charged up to the upper limit value, a voltage quadruple as high as the AC source Vs is applied to the discharge gap G. Since the resistor Z2 is set to be sufficiently larger than the impedance of the primary winding of the pulse transformer PT, at this time, there is applied substantially no voltage to the primary winding of the pulse transformer from the capacitor C2. Here, upon conduction of the discharge gap G, the charge in the capacitor C1 is discharged through the diode Z1, a current is caused to rapidly flow to the primary winding of the pulse transformer PT, so that a high pulse voltage is provided at the secondary winding of the pulse transformer PT.

In the present instance, FS08X-1 by SIEMENS, for example, is employed as the discharge gap G, similarly to the embodiment of FIG. 20, and the peak voltage of the AC source Vs is set to be 300V, whereby the voltage across the capacitor C1 will be 600V at the maximum value while the voltage across the capacitor C2 will be 900V at the maximum value, and the maximum voltage applicable upon non-conduction of the discharge gap G will be substantially 1200V. That is, the same operation as in the embodiment of FIG. 23 is attainable.

In the present embodiment, the impedance element Z2 functions to substantially prevent the voltage across the capacitor C2 from being applied to the primary winding of the pulse transformer PT, and is also used commonly as a current limiting element for limiting the charge current to the capacitor C1. Further, it is desirable to set the capacity of the capacitor C2 sufficiently smaller than the capacitor C1 so that, upon charging the capacitor C2 with the charge in the capacitor C1, the voltage of the capacitor C1 is prevented from being lowered so as to maintain the voltage across the capacitor C1 to be stable.

In another embodiment of FIG. 26, the arrangement is based fundamentally on the same technical idea of the arrangement of FIG. 22 and is useful as the igniter of the discharge lamp lighting device. In this igniter circuit 3, a series circuit of a diode D11 and capacitor C11 is connected through the resistor Z2 to the AC source Vs, and a series circuit of a diode D12 and capacitor C12 is connected also through the resistor Z2 to the AC source Vs. Here, the polarity of the diodes D11 and D12 is so set that the respective capacitors C11 and C12 are charged in periods in which voltage polarities of the AC source Vs are inverse to each other. To a series circuit of the capacitors C11 and C12, a series circuit of the primary winding of the pulse transformer PT and discharge gap G is connected through a diode Z1. Across the AC power source Vs, further, the resistor Z2, capacitor C11, diode Z1 and capacitor C2 are connected in series.

Figure 27A:
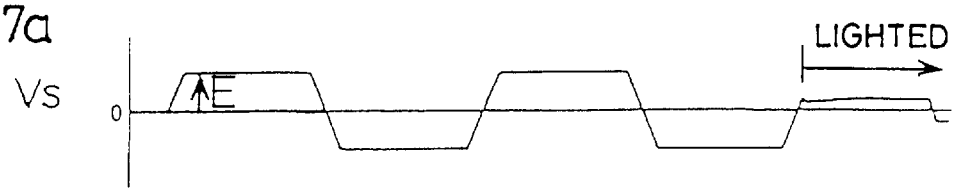
Figure 27B:
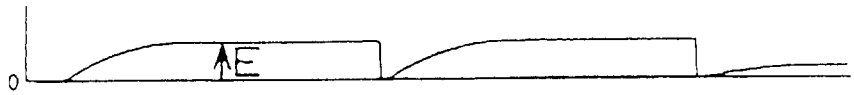
Figure 27C:
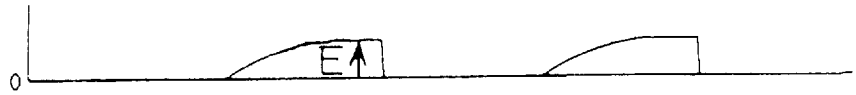
Figure 27D:
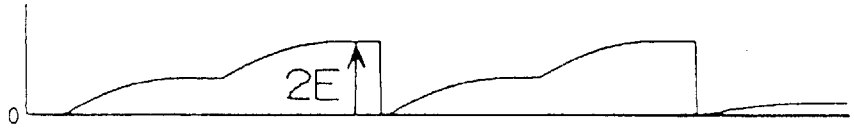

Provided that, in the present embodiment, the voltage of the AC source Vs (the polarity shown by an arrow in FIG. 26 is made the positive) varies as shown in FIG. 27*a*, the capacitor C11 is charged and discharged as shown in FIG. 27*b*, and the capacitor C12 is charged and discharged as shown in FIG. 27*c*. That is, the capacitors C11 and C12 are respectively charged to the peak voltage E of the source Vs. As the voltages across the capacitors C11 and C12 charged reach the peak voltage E of the source Vs, a voltage across the series circuit of the capacitors C11 and C12 will be 2E as shown in FIG. 27*d*.

Figure 27E:
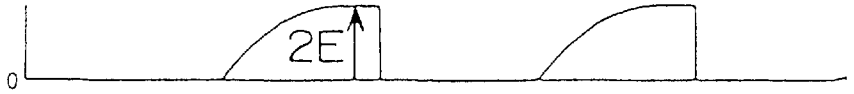
Figure 27F:
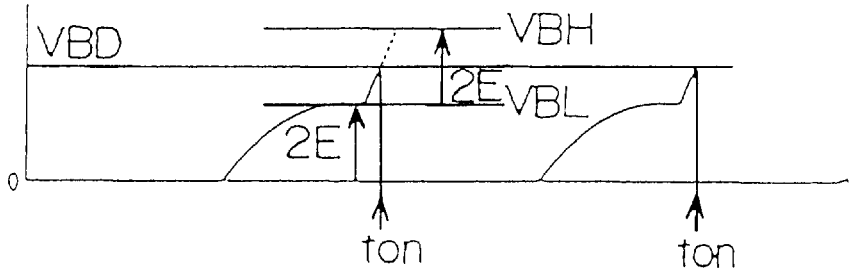

As the polarity of the AC source Vs is inverted after the capacitor C11 is charged to the peak voltage E of the source Vs, the voltage across the capacitor C11 is added to the voltage of the source Vs to cause the capacitor C2 charged thereby, and the voltage across the capacitor C2 becomes twice as high as the peak voltage E of the AC source Vs as shown in FIG. 27*e*. Therefore, when the polarity of the source Vs is inverted next, a voltage quadruple as high as the peak voltage E of the AC source Vs at the maximum as shown in FIG. 27*f* is applied to the discharge gap G by means of the series circuit of the capacitor C12, source Vs and capacitor C2.

Subsequent operation is the same as in the foregoing embodiments, the discharge gap G conducts to render the diode Z1 to conduct, and the charge in the series circuit of the capacitors C11 and C12 is made to quickly flow to the primary winding of the pulse transformer PT, to generate at the secondary winding of the pulse transformer PT a high voltage pulse output. While the voltage quadruple as high as the peak voltage E of the source Vs is applied before the conduction of the discharge gap G, the voltage across the series circuit of the capacitors C11 and C12 is applied to the primary winding of the pulse transformer PT upon conduction of the discharge gap G, instead of the voltage quadruple as high as the peak voltage E, because of the presence of the resistor Z2.

Here, the discharge gap G may be of the upper limit value VBH of the breakdown voltage VBD set to be below the voltage quadruple as high as the peak voltage E of the source Vs and of the lower limit value VBL set to be above the voltage twice as high as the peak voltage E. When, for example, the AC source Vs has a voltage waveform of square shape and a peak voltage of 300V, then the product FS08X-1 by SIEMENS will be employable.

As will be clear from the foregoing operation, in the present embodiment, the capacitors C11 and C12 function in the same manner as the capacitor C1 in the foregoing embodiment of FIG. 21, and the capacitors C2 and C12 function the same as the capacitor C2 in the foregoing embodiment of FIG. 21. Further, as the capacitor C2 is charged by the capacitor C11, it is desirable to set the capacity of the capacitor C2 to be sufficiently smaller than that of the capacitor C11, in order to maintain the voltage across the capacitor C11. Further, when the capacity of the capacitors C11 and C12 is made sufficiently larger than that of the capacitor C2, the output voltage of the secondary winding of the pulse transformer PT is determined mainly by the voltage across the capacitors C11 and C12. The impedance element Z2 functions to prevent any high voltage from being applied to the pulse transformer PT when the discharge gap G starts conducting and also functions as a current limiting element upon charging of the capacitors C11 and C12, while it is so set that the voltage across the capacitors C11 and C12 is charged up to the peak voltage E of the source Vs during each half cycle of the voltage waveform of the source Vs. With such setting, the high voltage pulse output can be obtained at the secondary winding of the pulse transformer PT in every 1 cycle of the voltage waveform of the source Vs.

In order to further reduce the influence of the voltage across the capacitor C2 on the output voltage of the secondary winding of the pulse transformer PT, an impedance element having an impedance sufficiently larger than the primary winding of the pulse transformer PT may be connected in series to the capacitor C2, to be between the diodes D12 and Z1. When the output voltage at the secondary winding of the pulse transformer PT is to be controlled mainly by means of the charge in the capacitor C2, an impedance element of a higher impedance than the primary winding of the pulse transformer PT may be connected between the series circuit of the capacitors C11 and C12 and the pulse transformer PT.

In addition, as shown in FIG. 26, a DC power source PS and a power converting circuit 4*a* for converting a DC voltage of the DC power source PS into a square wave AC voltage are constituted by a DC—DC converter of polarity inverting type for boosting the DC voltage, and an inverter for converting an output of the DC—DC converter into a low frequency alternating voltage. An igniter 8 is connected across output terminals of the power converting circuit 4*a*, and the discharge lamp 2 of the high pressure discharge lamp is connected thereto through the secondary winding of the pulse transformer PT. Further across the output terminals of the power converting circuit 4*a*, the capacitor Cp is also connected. Here, the power converting circuit 4*a* is provided with a function of ballast for the discharge lamp 2, and is arranged for outputting a voltage before starting of the lamp 2 higher than that after the starting. For the arrangement of this type, there has been known one which outputs a high voltage for a fixed period from the connection of the power source with a timer employed, or which controls the output voltage by detecting lighting state of the high pressure discharge lamp 2 with the lamp current or voltage detected. Thus, for example, the peak voltage is set to be 300V before the starting, and to be 80V after the starting.

Figure 27G:
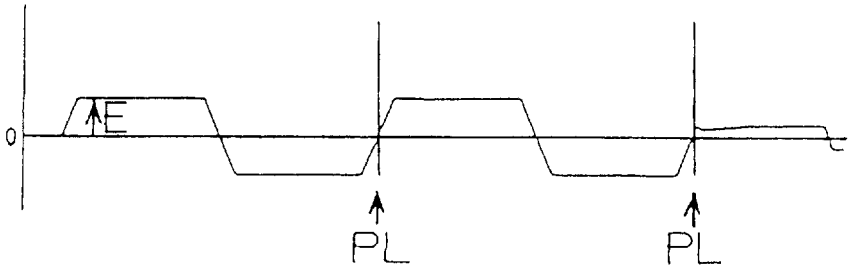

As the DC power source PS is connected in this arrangement, the higher voltage is provided from the power converting circuit 4*a*, and the igniter 3 provides the high voltage to the secondary winding of the pulse transformer PT through the operation of FIGS. 27*a*–27*f* as has been described. That is, such high voltage pulse PL as in FIG. 27*g* is applied to the high pressure discharge lamp 2, and the starting voltage is applied to the lamp 2. Generally in the high pressure discharge lamp, the application of the starting voltage causes a minute discharge to occur to produce ions within the light emitting tube, which discharge shifts thereafter to an arc discharge. As the shift to the arc discharge causes the output voltage of the power converting circuit 4*a* to be lowered, the high voltage pulse is no more generated at the secondary winding of the pulse transformer PT, so long as the output voltage of the circuit 4*a* is so set that a voltage quadruple as high as the peak value of the output voltage of the circuit 4*a* does not reach the breakdown voltage of the discharge gap G. That is, the igniter 3 stops its operation.

While in the present embodiment the power converting circuit 4*a* is employed as the ballast, it is also possible to employ, as the power source, such AC power source as commercial power source and, as the ballast, a choke coil (so-called magnetic type ballast). Further, a power source for the igniter 3 may be provided separately from the power source for the high pressure discharge lamp 2. The operation of this embodiment is the same as that in the embodiment of FIG. 26.

Still another embodiment takes into account that, in such event as shown in FIG. 27*a* where required time for the polarity inversion of the AC power source (output of the power converting circuit 4*a*) is relatively long, the timing at which the high voltage pulse PL is generated is caused to fluctuate due to a fluctuation in the breakdown voltage of the discharge gap G. This is because, as in FIG. 27*f*, the voltage applied to the discharge gap G rises with voltage variation upon the polarity inversion of the AC power source Vs.

When the device is used as the igniter similar to the case of FIG. 26, in contrast, the sum voltage of the high voltage pulse PL and the voltage of the AC source Vs (output voltage of the power converting circuit 4*a*) is applied to the discharge lamp 2 and it is desirable to generate the high voltage pulse PL at the time when the voltage of the AC source Vs is high. That is, it is preferable that the high voltage pulse PL is generated after the voltage of the AC source Vs has reached the peak voltage subsequent to the polarity inversion.

Here, the arrangement of FIG. 22 is made to insert a delay circuit between the AC source Vs and the capacitor C2, and it is enabled to delay the timing of applying to the discharge gap G the voltage of the AC source Vs as added to the voltage across the capacitor C2, so as to deviate the timing of generating the high voltage pulse PL. Further, it is possible to realize the same function when a capacitor Cd2 is connected in parallel to the discharge gap G (or in parallel to the series circuit of the primary winding of the pulse transformer PT and discharge gap G) to cause the timing of applying the high voltage to the gap G delayed.

FIG. 28 shows a practical circuit of an embodiment in which the discharge lamp lighting device in the embodiment of FIG. 26 is altered on the basis of the above technical matter, and, in the circuit of FIG. 26, a capacitor Cd1 is connected to a junction point of the resistor Z2 and the capacitor C2, and a series circuit of the resistor Z2 and capacitor Cd1 is connected across the output terminals of the power converting circuit 4*a*. In this arrangement, a delay circuit is constituted by the series circuit of the resistor Z2 and capacitor Cd1.

The operation of the foregoing embodiment of FIG. 28 is shown in FIGS. 29*a*–29*g*. When compared with the embodiment of FIG. 26, it is seen that, as in FIGS. 29*f* and 29*g*, the timing of generation of the high voltage pulse PL is delayed so that the high voltage pulse PL is generated after the voltage of the AC source Vs has reached the peak value. Other parts and operation are the same as those in the embodiment of FIG. 26.

Depending on the arrangement of the rectifying circuit for charging the first capacitors (C11 and C12 in the case of FIG. 26, for example), there is an event where a circuit bypassing these capacitors is formed, and a voltage inverse to the polarity of normal charging is not attained. In the embodiment of FIG. 26, for example, the diodes D11 and D12 form a bypass circuit, in which event a freewheeling path is formed by the conduction of the discharge gap G, the path passing through the primary winding of the pulse transformer PT, discharge gap G and the above bypass circuit, after the charge in the first capacitors is discharged.

With such circuit employed as the igniter 3 of the discharge lamp lighting device, the above freewheeling path attains a state equivalent to an event where the primary side of the pulse transformer PT is shortcircuited, while the discharge lamp 2 is still in high impedance state at a stage where the minute discharge has occurred with the starting high voltage pulse applied to the high pressure discharge lamp 2. Thus the energy of the high voltage pulse is almost used up on the primary side of the pulse transformer PT. That is, in applying the high voltage pulse to the high pressure discharge lamp 2, there arises a case in which the energy of the pulse is mostly consumed without being used for starting the lamp 2 and the energy cannot be effectively transmitted to the high pressure discharge lamp 2.

Figure 30:
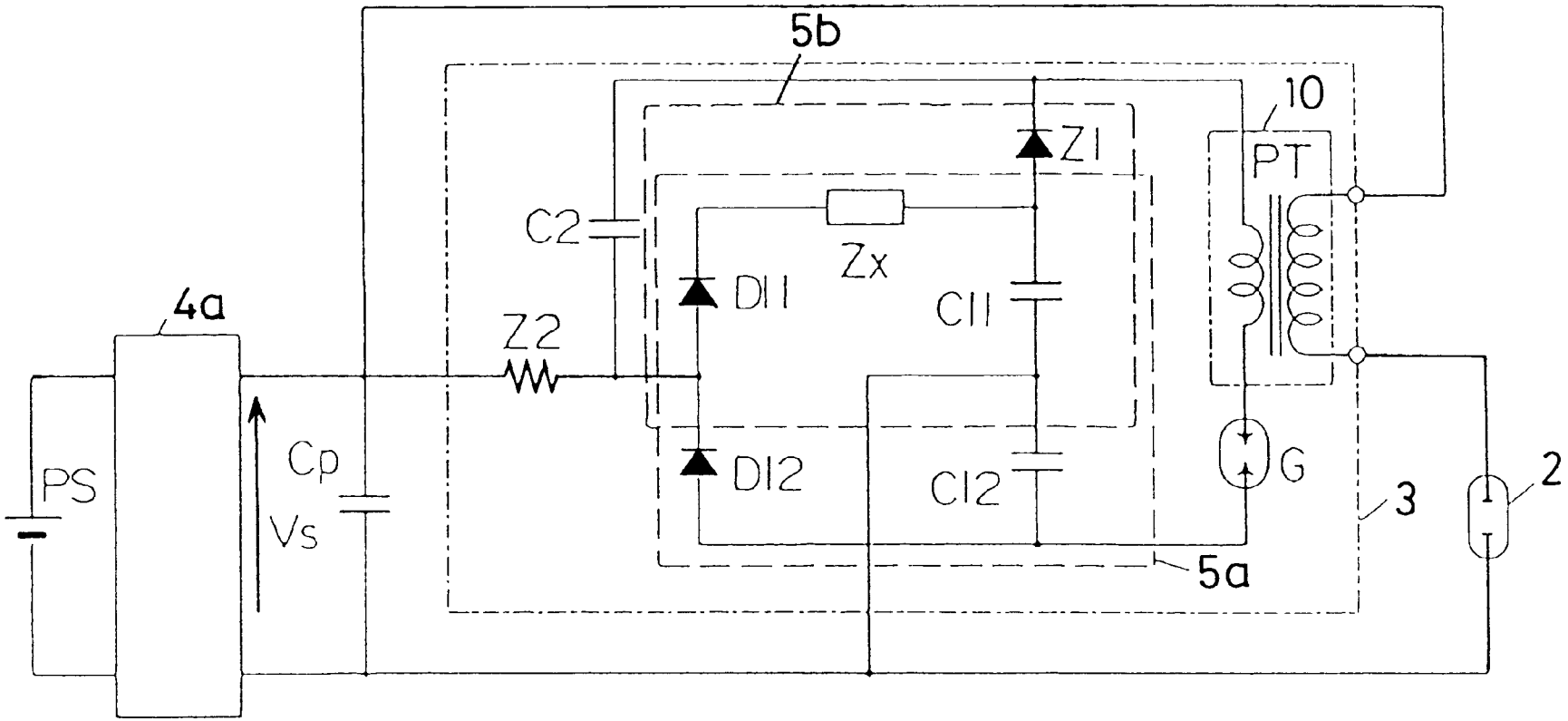

Another embodiment shown in FIG. 30 is to eliminate such drawback as in the above, and the current flowing to the freewheeling path is controlled by an impedance element Zx inserted in the freewheeling path, so that the energy of the high voltage pulse will be effectively transmitted to the discharge lamp 2. Here, the impedance element Zx should desirably be set to satisfy the ralationship of $Zx>ZL/k$, wherein ZL is the impedance of load connected to the secondary side of the pulse transformer PT and k is the turn ratio of the pulse transformer PT.

The present embodiment is constituted by applying the foregoing technique to the embodiment of the discharge lamp lighting device shown in FIG. 26. That is, the impedance element Zx is inserted between the diode D11 and the capacitor C11 so that a freewheeling path by means of the diodes D11 and D12 only will not be formed across the series circuit of the capacitors C11 and C12, and the current passing through the freewheeling path will be restrained by the insertion of the impedance element Zx in the freewheeling path. It is possible to insert the impedance element Zx at any part of the series circuit of the diode D11 and D12 which is connected across the series circuit of the capacitors C11 and C12.

The present embodiment can be applied not only to the embodiment of FIG. 26 but also to other but similar pulse generator.

In an event where the impedance element Zx is inserted in the freewheeling path as in the arrangement shown in FIG. 30, a current flows to the primary winding of the pulse transformer PT upon conduction of the discharge gap G and the charge in the capacitors C11 and C12 is discharged. Thereafter, a magnetic energy accumulated in the pulse transformer PT is discharged to charge the capacitors C11 and C12 again. However, a charging polarity of the capacitors C11 and C12 in this period is inverse to a charging polarity by means of the rectifying circuit 5*a*, and this energy cannot be utilized effectively. That is, it often occurs that even a charge of the capacitors C11 and C12 with an energy by means of a regenerative current of the pulse transformer PT will be a loss.

Figure 31:
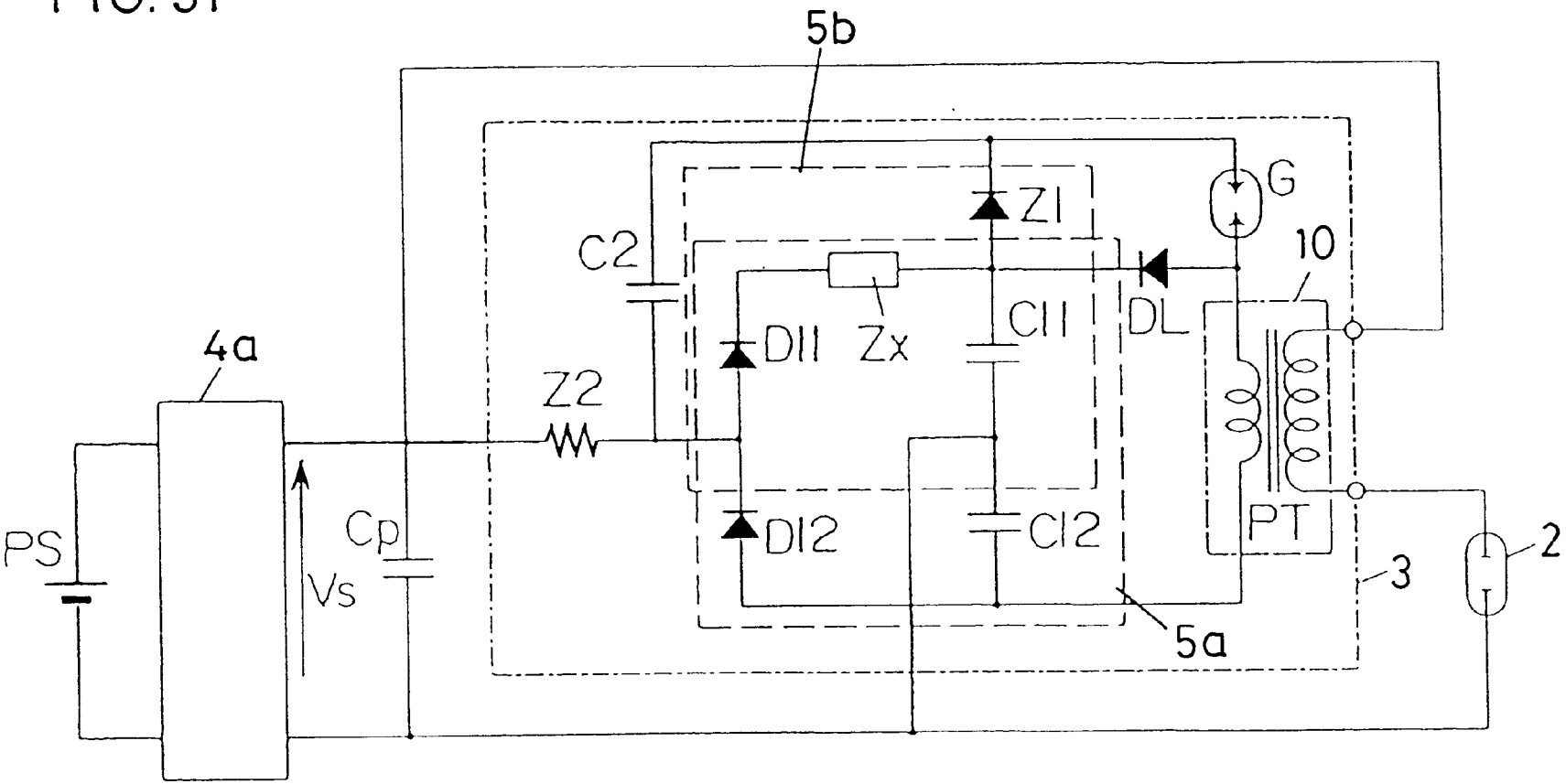

In the present embodiment, the arrangement is so made that, as applied to the arrangement of FIG. 30, a path for discharging through another diode a charge charged in inverse polarity after the discharge of the charge accumulated in the capacitors C11 and C12 is obtained, and the primary side of the pulse transformer PT is inserted in this path. More specifically, the arrangement will be as shown in FIG. 31. That is, in contrast to the embodiment of FIG. 30, the pulse transformer PT and discharge gap G are replaced with each other, a diode DL is connected between the discharge gap G and the anode of the diode Z1 with the anode disposed on the gap G side, and a series circuit of the capacitors C11 and C12 is connected across a series circuit of the primary winding of the pulse transformer PT and the diode DL. The characteristic operation of the present embodiment is as has been described, the conduction of the discharge gap G causes the charge in the capacitors C11 and C12 to be discharged, and the high voltage pulse is generated by the pulse transformer PT. Thereafter, the capacitors C11 and C12 are charged again with the magnetic energy of the pulse transformer PT after the discharge of the capacitors C11 and C12, then the charge in the capacitors C11 and C12 is discharged through the pulse transformer PT and diode DL, and it is made possible that the accumulated charge in the capacitors C11 and C12 which has been lost is utilized at the pulse transformer PT.

The above arrangement of the present embodiment is applicable not only to the embodiment of FIG. 30 but also to other and similar pulse generators.

Figure 32:
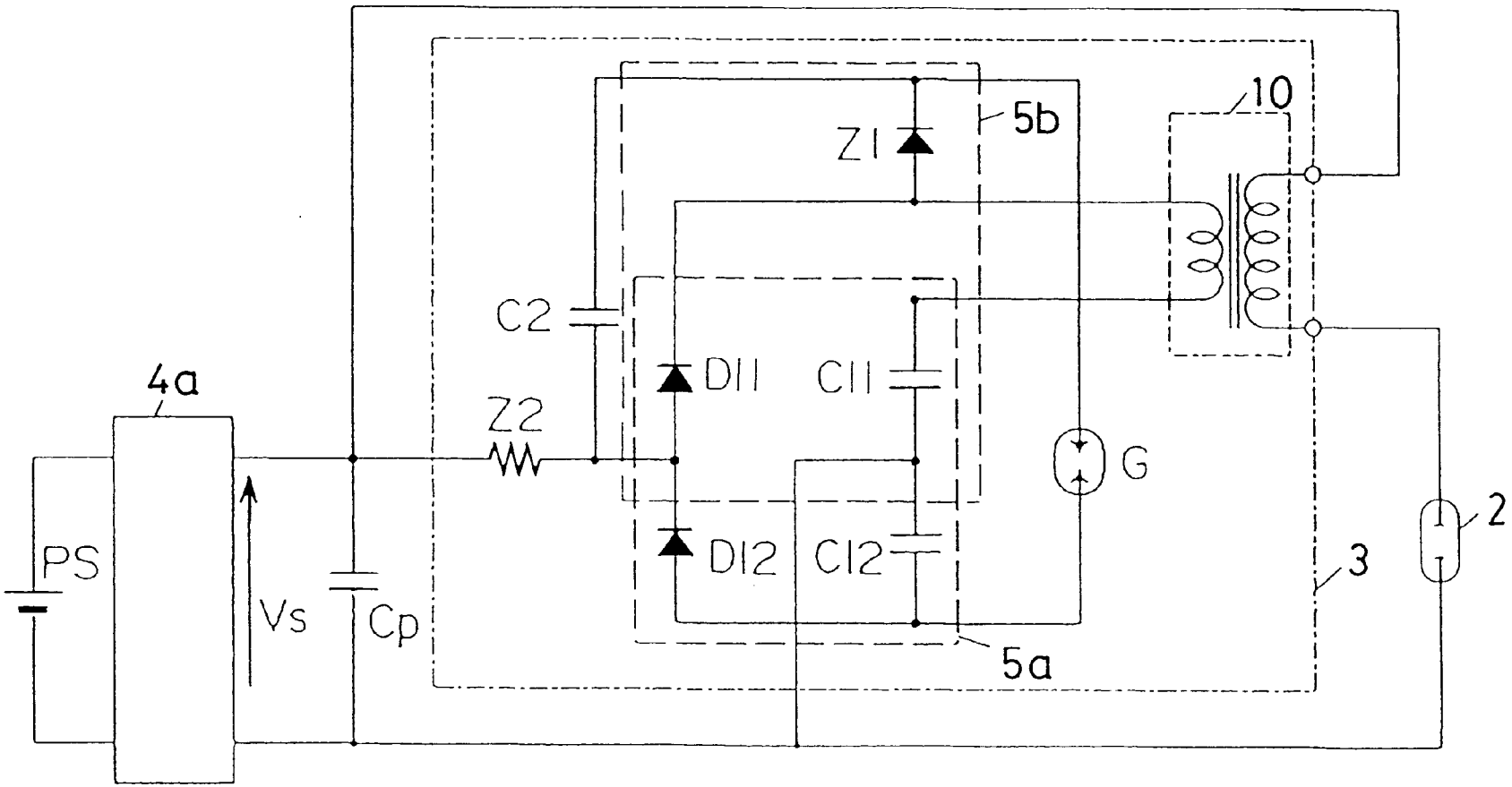

In another embodiment shown in FIG. 31, the diode DL is employed for forming the path for discharging the charge in the inverse polarity accumulated in the capacitors C11 and C12. However, in place of the impedance element Zx in the embodiment of FIG. 30, the primary winding of the pulse transformer may be inserted. At the same time, it is necessary that such element is inserted at a portion which allows the discharge current upon the conduction of the discharge gap G to flow to the primary winding of the pulse transformer PT. When this is applied to the embodiment of FIG. 28, the arrangement will be as shown in FIG. 32.

That is, the primary winding of the pulse transformer PT is connected between the cathode of the diode in the series circuit of the diodes D11 and D12 and an end of the capacitor C11 side in the series circuit of the capacitors C11 and C12, and the discharge gap G is connected through the diode Z1 to the series circuit of the diodes D11 and D12. Further, a series circuit of the discharge gap G and diode D12 is connected to the capacitor C2.

In order words, in the discharge path of the first capacitors C11 and C12, the connecting position of the pulse transformer as the load circuit is made to be a direct, series insertion to the first capacitors. Further, the present embodiment is applicable not only to the embodiment of FIG. 28 but also to any other and similar pulse generators.

Figure 33:
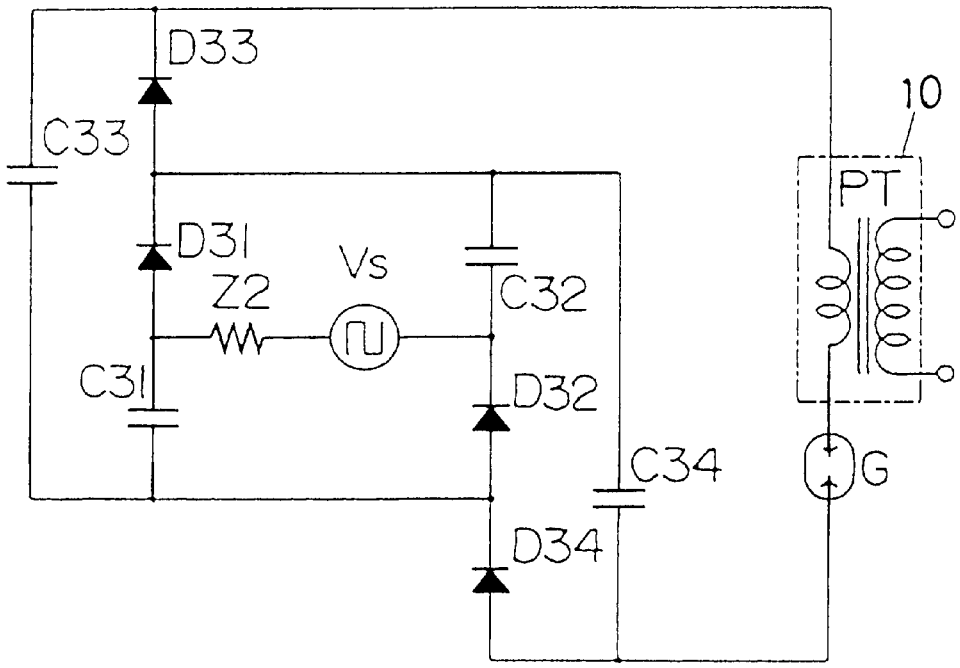

Another embodiment shown in FIG. 33 is to realize a function of applying a constant voltage to the discharge gap G after the conduction of the gap with a high voltage, by means of a rectifying circuit known as a Zimmerman circuit. In this case, a series circuit of a capacitor C31 and diode D31 connected at its anode to the capacitor C31 and a series circuit of a capacitor C32 and diode D32 connected at its cathode to the capacitor C32 are connected in parallel so that the capacitor C32 is connected to the cathode of the diode D31 and the capacitor C31 is connected to the anode of the diode D32. Further, the AC power source Vs is connected through a resistor Z32 between junction points of the capacitor C31 and diode D31 and of the capacitor C32 and diode D32. Further, a series circuit of a diode D33 and capacitor C33 connected to the cathode of the diode D33 is connected in parallel to the series circuit of the capacitor C31 and diode D31 so that the anode of the diode D33 is connected to the cathode of the diode D31.

With the above arrangement, the charging of the respective capacitors C31 and C32 to render the voltage across each of them to reach the peak voltage of the AC source Vs causes a sum voltage of the voltages across the capacitor C31 and of the source Vs and the voltage across the capacitor C32 to be applied through the diode D33 to the capacitor C33, and the voltage across the capacitor C33 is to reach a voltage treble as high as the peak voltage of the source voltage Vs.

Further, a series circuit of a diode D34 and capacitor C34 is also connected in parallel to the series circuit of the capacitor C31 and diode D31. While at this time the series circuit of the diode D33 and capacitor C33 is so connected that the cathode of the diode D33 is connected to the capacitor C33 and the anode of the diode D33 to the cathode of the diode D31, the series circuit of the diode D34 and capacitor C34 is so connected that the anode of the diode D34 is connected to the capacitor C34 and the cathode of the diode D34 is connected to the capacitor C31 and to the anode of the diode D32. Further, the series circuit of the primary winding of the pulse transformer PT and discharge gap G is connected at one end to the cathode of the diode D33 and at the other end to the anode of the diode D34.

In this case, the voltage across the capacitors C33 and C34 is made triple as high as the peak voltage of the AC source Vs by the foregoing operation of the Zimmerman circuit. Further, the voltage across the capacitors C31 and C32 will be the peak voltage of the source Vs, so that a voltage across a series circuit of the capacitor C34→capacitor C32→source Vs→resistor Z2→capacitor C31→capacitor C33 becomes five times as high as the peak voltage of the source Vs. That is, when in the above series circuit the polarity of the source Vs conforms to the polarity of the voltage across the capacitors C33 and C34, the polarity of the voltage across the capacitors C31 and C32 will be inversed, and a voltage as a balance of subtruction of the voltage twice as high as the peak voltage of the source Vs from the voltage seven-times as high as the peak voltage will be the voltage across the above series circuit. With this voltage applied to the discharge gap G through the primary winding of the pulse transformer PT, the discharge gap G can be conducted. With the provision of the resistor Z2, the arrangement is so made that the high voltage will not be applied to the primary winding of the pulse transformer PT upon conduction of the discharge gap G.

As the discharge gap G conducts, the voltage across the capacitors C33 and C34 which is treble as high as the peak voltage of the source Vs is applied to the primary winding of the pulse transformer PT, and a high voltage pulse is provided at the secondary winding of the pulse transformer. Therefore, the same function as that in the embodiment of FIG. 20 can be realized by the present embodiment. The diodes D33 and D34 correspond to the impedance element Z1.

Figure 34:
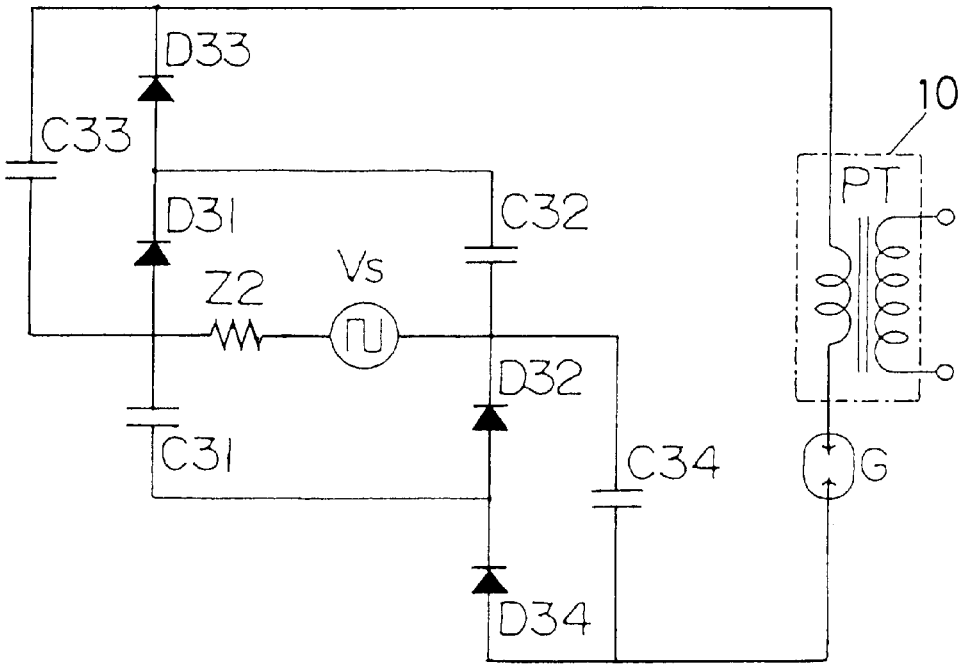

In another embodiment shown in FIG. 34, the circuit arrangement shown in FIG. 33 is modified. That is, a series circuit of the capacitor C33 and diode D33 as well as a series circuit of the capacitor C34 and diode D34 are connected in parallel respectively to each of the diodes D31 and D32.

In this arrangement, the voltages across the capacitors C33 and C34 respectively reach a level twice as high as the peak voltage of the AC source Vs. Therefore, before conduction of the discharge gap G, a voltage up to five times as high as the peak voltage of the source Vs is applied to the discharge gap G through a series circuit of the capacitor C34→AC source Vs→capacitor C33, and, after conduction of the gap G, a voltage treble as high as the peak voltage of the source Vs is applied to the primary winding of the pulse transformer PT through a series circuit of the capacitors C31 and C33 and through a series circuit of the capacitors C32 and C34. That is, the operation is the same as that in the embodiment shown in FIG. 33. Other parts and operation are the same as those in the embodiment of FIG. 33.

While in the respective embodiments described the discharge gap G has been referred to as the two-terminal voltage responsive switch, it should be readily appreciated that such other voltage responsive switch as SSS is applicable.

What is claimed is:

1. A pulse generator comprising a switching element of two-terminal voltage-responsive type which conducts when a voltage across the switching element reaches a predetermined responsive voltage, a trigger source means for applying across the switching element a voltage to render the switching element conductive, and an energy supply source means for supplying an energy to the switching element and to a load circuit connected in series to the switching element upon conduction of the switching element.

2. The pulse generator according to claim 1 wherein the trigger source means and the energy supply source means are connected mutually in parallel in equivalent manner and are connected to the switching element and load circuit, and the responsive voltage of the switching element is set to be lower than the voltage generated by the trigger source means and to be higher than a voltage generated by the energy supply source means.

3. The pulse generator according to claim 1 wherein the trigger source means and the energy supply source means are connected mutually in series in equivalent manner and are connected to the switching element and load circuit, and the responsive voltage of the switching element is set to be lower than a sum of the voltage generated by the trigger source means and the voltage generated by the energy supply source means but is higher than the voltage generated by the energy supply source means.

4. The pulse generator according to claim 1 wherein at least part of a first impedance element is connected in series to the trigger source means, and the first impedance element has an impedance set higher than an impedance of the load circuit.

5. The pulse generator according to claim 1 wherein a second impedance element including a forward directional diode which is connected in series to the energy supply source means, and at least said diode is connected equivalently in parallel to a series circuit of the trigger source means and a first impedance element.

6. The pulse generator according to claim 1 wherein the switching element is one selected from the group consisting of a gap element, a gas-charged gap element and a two-terminal voltage responsive semiconductor switching element which is conductive when a voltage across the switching element reaches a predetermined operating value but returns non-conductive when the voltage across the element drops and a current to the element reduces below a predetermined value.

7. The pulse generator according to claim 1 wherein the energy supply source means is one selected from the group consisting of a commercial AC power source, a DC power source and a pulsating voltage source.

8. The pulse generator according to claim 1 wherein the trigger source means is one selected from the group consisting of a series circuit of a DC power source and a switching means, a commercial AC source voltage, a pulsating voltage and a voltage substantially sequentially rising with time.

9. The pulse generator according to claim 1 wherein the load circuit comprises at least a pulse transformer a primary winding of which is connected equivalently in series with the energy supply source means and the switching element, and the trigger source means is arranged to trigger the switching element upon detection of a predetermined voltage for providing a required energy to the load circuit reached by a voltage at the energy supply source means.

10. The pulse generator according to claim 1 which further comprises a first rectifying circuit consisting of an n-times (n being an optional integer) voltage rectifier which rectifies an AC source power and provides a relatively low voltage, a second rectifying circuit consisting of an m-times (m being an optional integer) voltage rectifier which rectifies the AC source power and provides a relatively high voltage, and first and second capacitors respectively connected across output terminals of each of the first and second rectifying circuits, and the voltage responsive switching element is provided for conduction upon application, in non-conductive state, of a voltage which is at least a voltage across the second capacitor, the conduction of which switching element causing a charge in the first capacitor to flow through the switching element to the load circuit.

11. The pulse generator according to claim 10 wherein the first and second capacitors are connected in parallel to the voltage responsive switching element, and a voltage across the first capacitor is set at the upper limit value to be lower than a breakdown voltage of the voltage responsive switching element while the voltage across the second capacitor is set to exceed the breakdown voltage of the voltage responsive switching element.

12. The pulse generator according to claim 10 wherein the first and second capacitors are connected in series to the voltage responsive switching element when the element is non-conductive, and a voltage across the first capacitor is set in the upper limit value to be lower than a breakdown voltage of the voltage responsive switching element while a sum value of the voltages respectively across each of the first and second capacitors is set to exceed the breakdown voltage of the switching element.

13. The pulse generator according to claim 10 wherein the first capacitor is connected in parallel to the voltage responsive switching element, the AC power source and at least the second capacitor are connected in series to the voltage responsive switching element when the element is non-conductive, and the voltage across the first capacitor is set in the upper limit value to be lower than the breakdown voltage of the voltage responsive switching element while a sum value of a peak value of an AC voltage of the AC source and the voltage across at least the second capacitor is set to exceed the breakdown voltage of the switching element.

14. The pulse generator according to claim 10 wherein the first capacitor comprises a series circuit of a plurality of split capacitors; the AC power source, part of the split capacitors forming the first capacitor and the second capacitor are connected in series to the voltage responsive switching element when the element is non-conductive; and the voltage across the first capacitor is set in the upper limit value to be lower than the breakdown voltage of the voltage responsive switching element, while a sum value of the peak value of an AC voltage of the AC source, the voltage across the split capacitors and the voltage across the second capacitor is set to exceed the breakdown voltage of the voltage responsive switching element.

15. The pulse generator according to claim 10 wherein the load circuit is inserted in a path for applying to the voltage responsive switching element a voltage including the voltage across the second capacitor, an impedance element of a sufficiently larger impedance than the load circuit in said path is connected in series to the second capacitor; and the impedance element comprises one of the second capacitor equivalently employed as the impedance element by setting the capacity of the second capacitor smaller than that of the first capacitor to render the impedance of the second capacitor to be higher, and an impedance element included in other circuit elements.

16. The pulse generator according to claim 15 wherein a series circuit of another impedance element for blocking a shift of charge from the second capacitor to the first capacitor and of the first capacitor is connected in parallel at least to a series circuit of the second capacitor and impedance element.

17. The pulse generator according to claim 16 wherein said another impedance element includes a diode connected in series to the first capacitor in a polarity allowing a discharge current of the first capacitor to flow.

18. The pulse generator according to claim 10 wherein a series circuit of the first and second diodes and a series circuit of the first and second capacitors are connected in parallel; the AC power source is connected between a junction point of the first and second diodes and a junction point of the first and second capacitors; and a third capacitor is connected between an end of the series circuit of the first and second capacitors and, through the impedance element, the junction point of the first and second diodes; the voltage responsive switching element is connected between a junction point of the first impedance element and third capacitor and the other end of the series circuit of the first and second capacitors; and the load circuit is inserted in at least one of discharging paths of the respective capacitors formed upon conduction of the voltage responsive switching element.

19. The pulse generator according to claim 10 wherein a delay circuit is provided at a connecting part to the AC power source to cause a rise of applied voltage to the voltage responsive switching element to be delayed.

20. The pulse generator according to claim 10 wherein a bypass circuit including an impedance element is provided to prevent the first capacitor from being charged with a voltage in a polarity inverse to a polarity allowing a discharge current to flow from the first capacitor to the load circuit.

21. The pulse generator according to claim 10 wherein a discharging diode is additionally inserted between the first capacitor and the load circuit in a direction allowing to flow a current of an inverse polarity to a polarity allowing a discharge current to flow from the first capacitor to the load circuit.

22. The pulse generator according to claim 10 wherein the load circuit comprises at least a pulse transformer.

23. A high pressure discharge lamp lighting device comprising a first rectifying circuit consisting of an n-times (n being an optional integer) voltage rectifier for rectifying a source voltage of an AC power source and providing a relatively low voltage, a second rectifying circuit consisting of an m-times (m being an optional integer) voltage rectifier for rectifying the AC power source power and providing a relatively high voltage, first and second capacitors respectively connected across output terminals of each of the first and second rectifying circuits and a load circuit including a high pressure discharge lamp, and a voltage responsive switching element provided for conduction upon application, in non-conducting state, of a voltage including a voltage across the second capacitor, a charge in the first capacitor being made to flow through the voltage responsive switching element to the discharge lamp in the load circuit upon conduction of the switching element.

24. A high-pressure discharge lamp lighting device wherein a high pressure discharge lamp is connected at least through a ballast element and a secondary winding of a pulse transformer, the device comprising a DC power source providing a DC power obtained by rectifying an output voltage of the ballast element, a series circuit of a switching element connected to the DC power source and a primary winding of a fly-back transformer, a series circuit of a rectifying element connected to a secondary winding of the fly-back transformer and a first capacitor, an energy supply source means consisting of a DC voltage boosting means for accumulating a high voltage energy across the first capacitor with a driving means for a high speed ON/OFF operation of the switching element, a closed circuit formed by connecting a series circuit of a primary winding of the pulse transformer and a further switching element consisting of a gap element at least across the first capacitor, a trigger source means formed by connecting a series circuit a secondary winding of a trigger transformer and a second capacitor and further connecting a series circuit of a primary winding of the trigger transformer and the further switching element to the DC power source, and a pulse generator for generating a starting high voltage pulse across the discharge lamp through the secondary winding of the pulse transformer with a current caused to flow to the closed circuit by turning the further switching element ON when the voltage across the first capacitor has reached a predetermined voltage.

* * * * *